US005472645A

United States Patent [19]

Rock et al.

[11] Patent Number: 5,472,645

[45] Date of Patent: Dec. 5, 1995

[54] CYCLONE VORTEX SYSTEM AND PROCESS

[75] Inventors: Howard P. Rock; Kelly P. Rock, both of Salt Lake City, Utah; Grant R. Wood, Billingham, Wash.

[73] Assignee: Cyclone Technologies, Inc., Salt Lake City, Utah

[21] Appl. No.: 346,257

[22] Filed: Nov. 23, 1994

[51] Int. Cl.[6] ..... F02M 23/12

[52] U.S. Cl. ..... 261/79.1; 261/DIG. 21; 261/DIG. 55

[58] Field of Search ..... 261/79.1, 79.2, 261/DIG. 21, DIG. 55

[56] References Cited

U.S. PATENT DOCUMENTS

| | | | |
|---|---|---|---|
| 1,036,812 | 8/1912 | Edmonson | 261/79.1 |
| 1,105,134 | 7/1914 | Hanemann | 261/79.1 |
| 1,381,253 | 6/1921 | Thomasson | 261/79.1 |
| 1,471,220 | 10/1923 | Tangye | 261/79.1 |
| 1,867,742 | 7/1932 | Hawley | 261/79.1 |
| 2,017,043 | 9/1935 | Galliot . | |
| 2,282,225 | 5/1942 | Hawley | 261/79.2 |
| 2,300,417 | 11/1942 | Hall | 261/79.2 |
| 2,633,836 | 4/1953 | Cox . | |
| 2,655,356 | 10/1953 | Borcherts | 261/79.1 |
| 3,233,879 | 2/1966 | Mitchell | 261/79.2 |
| 3,512,359 | 5/1970 | Pierce | 261/79.1 |
| 3,651,619 | 3/1972 | Miura | 261/79.2 |
| 3,720,058 | 3/1973 | Collinson | 261/79.1 |
| 3,811,278 | 5/1974 | Taylor et al. | 261/79.2 |
| 4,092,966 | 6/1978 | Prosen | 261/79.1 |
| 4,464,314 | 8/1984 | Surovikin et al. | 261/79.2 |
| 4,515,734 | 5/1985 | Rock et al. | 261/79.1 |
| 4,568,500 | 2/1986 | Rock et al. | 261/79.1 |
| 4,715,346 | 12/1987 | Dempsey | 261/79.1 |

FOREIGN PATENT DOCUMENTS

| | | | |
|---|---|---|---|
| 1156341 | 5/1958 | France | 261/79.2 |
| 74209 | 11/1960 | France | 261/79.2 |
| 1108666 | 6/1961 | Germany | 261/79.2 |
| 0829124 | 5/1981 | U.S.S.R. | 261/79.2 |
| 1357032 | 12/1987 | U.S.S.R. | 261/79.2 |

*Primary Examiner*—Tim R. Miles

*Attorney, Agent, or Firm*—Willian Brinks Hofer Gilson & Lione

[57] ABSTRACT

This invention relates to a system and process for fuel or liquid preparation including a plurality of vortex stacks of sequential vortex elements operationally coupled with an integrated pre-manifold centrifuge type-cyclone scrubber. Each vortex stack comprises a base vortex element having a fuel-air mixture input followed by varying arrangements of air-accelerator vortex elements. An electronic fuel injection managed fuel-air mixture enters each base vortex element creating a vortical (spinning) column, which is enhanced and accelerated by transonic-sonic velocity air inflows in the accelerator vortex elements. Entrained fuel aerosol droplets are sheared into a viscous vapor phase, and then into a gas-phase state. The vortical column containing turbulently vaporized fuel and any residual aerosols in the air mixture is then passed through a venturi to the scrubber where the mixture is homogenized and any collected aerosols are returned as liquid and re-processed by the system. This allows only the vaporized, chemically stoichiometric (oxygen balanced) and combustion ready gas-phase fuel to exit the system.

21 Claims, 12 Drawing Sheets

CYCLONE VORTEX SYSTEM AND PROCESS

BACKGROUND OF THE INVENTION

The present invention is directed broadly to an improved fluid vaporizing apparatus and method for producing a gas-phase mixture.

The present invention is directed more specifically to an improved fuel vaporizing system and associated process for producing a vaporized chemically-stoichiometric gas-phase fuel-air mixture for use in internal combustion engines.

In the context of this document the terms "Vaporize", "Vaporizing", "Vaporized" or any derivative thereof means to convert a liquid from an aerosol or vapor-phase to a gas-phase by means of vorticular turbulence.

Internal combustion engines (both diesel and otto-cycle gasoline) currently employ various systems for supplying a fuel aerosol of liquid fuel droplets and air, either directly into the diesel engine combustion chamber where compression heat ignites the fuel-air mixture or with a carburetor or fuel injection device(s) through an intake manifold into an otto-cycle engine combustion chamber where an electric spark ignites the mixture of air and fuel vapor, which is produced as the smaller aerosol droplets vaporize. In all currently employed systems this fuel-air mixture is produced by atomizing a liquid fuel and supplying it as a fuel aerosol into an air stream. But, in order for fuel oxidation within the combustion chamber to be chemically complete, the fuel-air aerosol must be vaporized to a chemically-stoichiometric gas-phase mixture. Stoichiometricity is a condition where the amount of oxygen required to completely burn a given amount of fuel is supplied in a homogeneous mixture resulting in optimally correct combustion, with no residues remaining from incomplete or inefficient oxidation. Ideally, the fuel aerosol should be completely vaporized, intermixed with air and homogenized PRIOR to entering the combustion chamber. Aerosol fuel droplets do not ignite and combust completely in any current type of internal combustion engine.

As a result, unburned fuel residues are exhausted from the engine as pollutants such as hydrocarbons (HC), carbon monoxide (CO), and aldehydes, with concomitant production of oxides of nitrogen (NOx). These residues require further treatment in a catalytic converter(s) to meet current emission standards and result in additional fuel costs to operate the catalytic converter(s). A significant reduction in any or all of these pollutants and the required control hardware would be highly beneficial, both economically and environmentally.

Moreover, a fuel-air mixture that is not completely vaporized and chemically-stoichiometric results in incomplete combustion, causing the internal combustion engine to perform inefficiently. Since a smaller portion of the fuel's chemical energy is converted to mechanical energy, fuel energy is wasted, thereby generating unnecessary heat and pollution.

The mandate to reduce air pollution has necessitated attempts to correct or compensate for combustion inefficiencies with a multiplicity of fuel system and internal-engine modifications and also add-ons. These various external control devices are all intended to more completely vaporize-homogenize fuel-air mixtures. As evidenced in the prior art concerning fuel preparation systems, much effort has been expended to reduce the aerosol droplet size and increase system turbulence while providing sufficient heat and enough residence time to evaporate-vaporize the fuels to allow complete combustion. However, the achievement of total aerosol vaporization has proven difficult because current liquid hydrocarbon fuels, such as gasoline, are mixtures composed of numerous "tray fractions" from the oil refinery fractionating tower. The lighter and more volatile fuel fractions vaporize and combust when the fuel is subjected to combustion heat with in-cylinder heat-turbulation. Heavier and less volatile components require additional kinetic energy and cylinder residence time to obtain sufficient molecular agitation and particle size-weight reduction for vaporization. As evidenced by the present internal combustion engine pollution emissions, these problems have been moderated but never solved.

As paradoxical as it may seem, the present problems of engine inefficiency and resultant harmful emissions exist because of a "misdirection" or "mistake" in the early days of combustion engine development. The first gasoline engines used a simple device that included a series of fuel saturated cloth wicks, or panels, through which the air was drawn into the intake manifold by engine vacuum. As the air moved past or through the wicks, the gasoline vapors were drawn into high compression ratio engine cylinder(s). Combustion was then initiated by means of a very crude live flame or electric spark ignition system. This fuel-air mixture was in fact a very combustible and efficient vapor-phase. The problem developed because as the more volatile fuel molecules were removed from the gasoline, the fluid left behind in the tank became less and less volatile and heavier in specific gravity until the engine would not satisfactorily operate. This system left a troublesome, heavy, non-volatile, oily residue which was totally unsuitable as a spark ignition-otto-cycle engine fuel, and which then had to be drained from the fuel tank and discarded. When the tank was resupplied with fresh gasoline, the engine would again run and the process was started over.

The solution was ingeniously simple, BUT WRONG, and involved dripping fresh fuel taken from the bottom of the fuel tank into the engine inlet air stream, thus creating a FUEL AEROSOL MIXTURE, which could only be utilized in very low-compression ratio gasoline engines because of detonation problems. Continued aerosol fuel system developments produced the up-draft venturi otto-cycle type carburetion devices and the diesel cycle compression ignition engine. Next followed mechanical fuel pumps to feed down draft carburetors with single, then multiple throats, and more recently, the many variations and improved types of direct and indirect fuel injectors for both gasoline and diesel engines which all produce fuel aerosols.

This sequential series of developments covers approximately 100 years, with every significant improvement directed at creating a more effective fuel aerosol. Today, both diesel injection and otto-cycle gasoline fuel systems continue to create at best inefficient fuel aerosols. These aerosols contain both gas vapor and liquid fuel droplets, which droplets generate power only if the droplets can be heat vaporized and burned during the combustion "cycle" time in the engine combustion chamber. Due to the carbon particulates resulting from this process, the combustion that occurs is termed "luminous flame combustion" and is incomplete. As a result, otto-cycle gasoline internal combustion engines utilizing aerosol fuel systems are severely limited by specific fuel combustion characteristics, fuel type and grades, and cannot employ high compression ratios (20:1 or above) because of detonation "knock." Moreover, this luminous flame combustion from aerosol fuels occurs above 2800° F. and inherently causes NOx (oxides of nitrogen) to form in both diesel and gasoline engines.

In hindsight, fuel system development over the last 100 years has followed an inefficient but effective path. High combustion temperatures and inefficient initial fuel preparation result in high amounts of emission pollutants, which then require some type of control elements. The control elements currently in use, in the form of exhaust gas recirculation, camshaft modifications, retarded timing, lowered compression ratios, catalytic converters, air injection reactors, etc. have all compounded engine inefficiency. Total and complete fuel vaporization would allow the actual achievement of stoichiometric fuel oxidation to CO2 and H2O with significant improvements in pollution emissions. However, the current path being followed to solve the pollution-emissions problem appears to be directed at following the technologically difficult route(s) of specialized fuels, electric vehicles, exotic batteries, etc.

One solution to the above dilemma is the use of technology which actually does achieve stoichiometric fuel/oxidizer proportions as a combustion reality. The key is to reduce the fuel aerosol droplet size close to the molecular level so that complete (or nearly complete) vaporization to the gas phase occurs within the existing time, temperature and turbulence constraints of the fuel preparation system PRIOR to fuel-air mixture entry into the combustion chamber.

There have been attempts in the prior art, which have relied on a turbulent circulation of the fuel-air mixture to separate the unvaporized portion of the fuel-air mixture from the vaporized portion and to provide only the vaporized portion of the fuel-air mixture to the intake manifold of an internal combustion engine.

For example, the separator patented by Edmonson, U.S. Pat. No. 1,036,812, uses a heated spiral-shaped conduit 9 to help volatilize the liquid hydrocarbon passing through the conduit. In addition, the conduit subjects the liquid hydrocarbon to centrifugal action to throw the heavier-unvolatilized hydrocarbon particles against a perforated plate 15 to break up the particles or to pass the heavier particles through perforations 16 and thereby return the heavier particles to the conduit.

A device disclosed by Cox in U.S. Pat. No. 2,633,836, is interposed between the intake manifold inlet and the carburetor outlet to both separate liquid fuel (in the form of suspended or entrained droplets), from the fuel-air mixture flowing from the carburetor and to vaporize a portion of the liquid fuel. The separating or further vaporizing functions are accomplished by passing the fuel-air mixture through spiral passages or conduits that divide the flow of the fuel-air mixture. The passages or conduits impart a centrifugal or swirling force on the fuel-air mixture, causing fuel droplets to be deposited on the side walls of the conduits/passages, from which walls the droplets are drained and returned to the fuel line.

Another device, in the form of a carburetor, was disclosed by Dempsey in U.S. Pat. No. 4,715,346. This carburetor includes three mixing chambers 12, 14, 16 arranged vertically in tandem. Gasoline spray and air enter the outer chamber of top chamber 12 through slot 60, flow spirally toward the central portion of the top chamber, enter the intermediate chamber 14 at its central portion, flow spirally outwardly toward the outer portion of the intermediate chamber, enter the bottom chamber 16 at its outer portion, flow spirally toward the central portion 90 of the bottom chamber and exit into the manifold of an engine. Heavy aerosol particles are separated from the fuel-air mixture at the central portion of the first chamber, collected in a reservoir 71, passed through a heater 104, and fed back into the fuel-air mixture at the center of the intermediate chamber 14.

These prior art devices and processes are ineffective to produce total vaporization of the fuel. Moreover, the prior art devices and processes do not produce a "complete" homogeneous intermixing of the fuel vapor with combustion air.

On the other hand, the device patented by Rock et al., U.S. Pat. Nos. 4,515,734 and 4,568,500 (the same inventors as for the present invention) provides vaporized fuel to the intake manifold of an engine. Rock et al. described a series of mixing sites, including a venturi housing 172 for homogenizing and vaporizing fuel and air. The mixture passes tangentially into a fuel separating cyclone housing 190. In use, the fuel and air mixture entering the housing 190 circulates vortically at high speeds within an annular chamber 334. Any remaining non-vaporized or larger particles of fuel are impacted centrifugally against the interior surfaces of the walls 302 and 310, accumulated, and caused to flow by the force of gravity via a fuel return chute 336 to one of said mixing sites to be recycled into the venturi housing. A fully vaporized and homogeneous fuel-air mixture, absent any large particles of fuel, spills over the top edge 326 into the barrel 320 of the housing 190 and thence, into the intake manifold of an internal combustion engine. Essentially, only partially vaporized fuel reaches the cylinders of the engine.

The Rock et al. device provides important advantages in the operation of an internal combustion engine by cyclonically recycling non-vaporized particles of fuel, allowing almost total burning of all hydrocarbons in an associated engine. Nevertheless, there is a problem with the Rock et al. device in that the fuel-air mixture reaching the fuel-separating housing 190 contains too many non-vaporized particles of fuel, which should be recycled. The device only utilizes one mixing site to process the recycle fuel, which often leads to overloading the recycle system with resultant engine detonation from introducing aerosols into the engine combustion process. As a result, the device is not useful in an internal combustion engine having a compression ratio higher than standard production vehicles. It would be very advantageous if the device could be improved so that the fuel-air mixture could be completely vaporized to a gas-phase prior to entering the housing 190.

SUMMARY OF THE INVENTION

In accordance with the present invention, an apparatus and process of fluid treatment are provided wherein middle cut distillate gasoline fuels and other industrial fluids of similar consistency are processed into an intermediate state as an aerosol and finally into the end product; a totally vaporized gas-phase fuel-air mixture.

An object of this invention is to allow otto-cycle internal combustion engines to operate on a fuel-air mixture in the gas-phase state at the normal 8:1–9.5:1 compression ratios or at efficiency enhancing mechanically attainable compression ratios, i.e., 20:1 OR ABOVE and with significantly reduced emissions.

According to the invention, a cyclone vortex system (CVS) and method are disclosed for converting liquid hydrocarbon fuels to gas-phase fuel-air mixture having optimal combustion properties for internal combustion engines. The system is configured with separate functional sections, which process the fuel prior to entering the engine and combustion chamber. The system can be optimized for efficient operation at high compression ratios in an internal combustion engine, while keeping combustion temperatures below 2800° F.

The system is arranged in three distinct operating sections. The first section is a fuel vaporizing section that encompasses multiple vortex units arranged in series, which systematically vaporize the short chain and most of the long chain hydrocarbon and aromatic molecules. The second section is the main air section that includes an air intake and a butterfly throttle valve which controls the air fuel flow rate into the venturi chamber. The third section is a fuel scrubbing and mixing section that includes the main cyclone or centrifugal chamber, where the remaining unvaporized fuel aerosol droplets are removed from the air stream and recycled back to a multiple vortex stack where they are vaporized during subsequent processing through a recycle vortex stack.

Liquid fuel and air are moved turbulently at near sonic speed through a multiple vortex configuration comprising a series of multiple vortex chambers, and finally through a larger cyclone or centrifuge chamber which also serves as a significant air-fluid mixing chamber. The vortex chambers break the liquid fuel down into an air-fluid stream of vaporized or gas-phase elements containing some unvaporized aerosols containing hydrocarbons of higher molecular weight. The process begins with the lighter fuel distillates being quickly vaporized to the gas-phase, homogeneously mixed with air and fed to an internal combustion engine. The heavier fuel portions (heavy ends) are also transformed into a gas-phase-vaporized state before they can exit the cyclone vortex system (CVS) and enter the distribution or intake manifold of an engine.

In the preferred embodiment, the multiple vortex configuration includes a pair of vortex stacks, each containing three vortex units. The three units of each stack are joined together in a tiered sequence to form a series of vortex turbulence chambers. A main flow path in the form of a column of fuel and air circulates at near sonic velocity within each of the three chambers. Fuel is metered to both vortex stacks by electronically controlled fuel injectors. One vortex stack (fresh fuel stack) is fed only fresh fuel, and the other vortex stack (recycle fuel stack) operates on mixed fuel, which is a combination of fresh fuel and liquid recycle fuel that has separated or recondensed and been collected from the gas-phase and aerosol fuel-air mixture resulting from the first pass through the fresh fuel stack and into the centrifuge scrubber cyclone mixing chamber.

Each triple vortex stack includes a base vortex unit having three tangential apertures in the rim thereof and also two accelerator vortex units situated sequentially thereto. Each accelerator unit has three apertures arranged tangentially to the main axial flow path. Air flow is introduced tangentially into the chambers of the accelerator vortex units to further enhance the shear forces acting upon, and in concert with, the turbulent axial column of aerosol-fuel-air mixture to convert the fuel aerosols in the mixture to a gas-phase. All of the gas-phase fluid containing unvaporized fuel aerosols from both vortex stacks is passed through a throttled venturi chamber and into the cyclone centrifuge-scrubber mixing chamber.

As the air-fuel gas-phase and fuel aerosol mixture enters the cyclone centrifuge chamber, centrifugal force, an air flow directional change, and a significant pressure drop slow the vortical speed allowing the entrained unvaporized fuel aerosol particles to impinge on the surfaces of the centrifuge chamber. This unvaporized fuel is collected into a floor channel in the centrifuge chamber as a liquid. The configuration of the chamber is significant in providing the air (oxygen) and fuel particles greater contact, or "loiter" time which assists in completing the gasification by using the vortex, venturi and centrifuge chambers to increase the "mean free path" which the fuel-air mixture takes from initial mixing to combustion. The collected aerosols, or recycle liquid, is returned to the recycle vortex stack through appropriate conduits-channels for reprocessing. Only a clean, gas-phase air-fuel mixture, free of all liquid or aerosol particles is introduced into the engine. In effect, only a vaporized oxygen-balanced non-recondensible chemically-stoichiometric gas-phase fuel-air mixture enters the engine intake manifold.

Through this unique device and process, the cyclone vortex system provides important advantages. All fractions of the fuel are transformed into an ideally combustible, molecularly-oxygen balanced, stoichiometric gas phase state, before entering the engine. Unlike conventionally mixed air-aerosol fuels, the gas-phase component burns to chemical completeness.

The in-cylinder combustion temperature of the gas-phase fuel-air mixture is below 2800° F. The low operating temperatures made possible by the cyclone vortex system precludes, for the most part, the creation of NOx (oxides of nitrogen). In essence, substantially all that remains to be exhausted from the engine and the combustion process is carbon dioxide and water. No carbonaceous deposits are left within the engine and only the so called "crevice emissions" are exhausted from the engine cylinder.

The cyclone vortex system has the benefit of providing for the efficient combustion of all appropriate fuels by vaporizing the fuel to a gas phase and combining the gas-phase fuel homogeneously with air prior to entry into the engine combustion chamber. The liquid fuel is transformed into a homogeneous mixture of gas-phased chemical hydrocarbon compounds that are stoichiometrically mixed with oxygen, and which results in improved distribution to the cylinders, and greatly improved combustibility.

The ability of the cyclone vortex system to eliminate the in-cylinder detonation potential of processed liquid-aerosols, and even gaseous hydrocarbon propane or cryogenic or liquid natural gas etc. fuels is important since it allows compression ratios to be raised to the mechanical limits of the gasoline engine, which is often in the range of 22:1 but can be as high as 40:1.

It is now apparent that dramatically improved fuel economy with increased power and engine performance together with the elimination of most polluting emissions are the real demonstrated advantages of the cyclone vortex system. An additional advantage is that the CVS also allows the utilization of very high compression ratios for even greater efficiency.

The invention itself, together with further objects and attendant advantages, will best be understood by reference to the following detailed description, taken in conjunction with the accompanying drawings.

BRIEF DESCRIPTION OF THE DRAWINGS

FIG. 10 is a bottom view of the venturi body of the cyclone vortex system, showing the openings for air, vaporized fuel, air and fuel aerosol, and recycle fuel, to pass through.

FIG. 18(*b*) is a chart showing the heavier components in the recycle liquid.

DETAILED DESCRIPTION OF THE INVENTION

Like numerals are used to designate like parts throughout the drawings.

Figure 1:
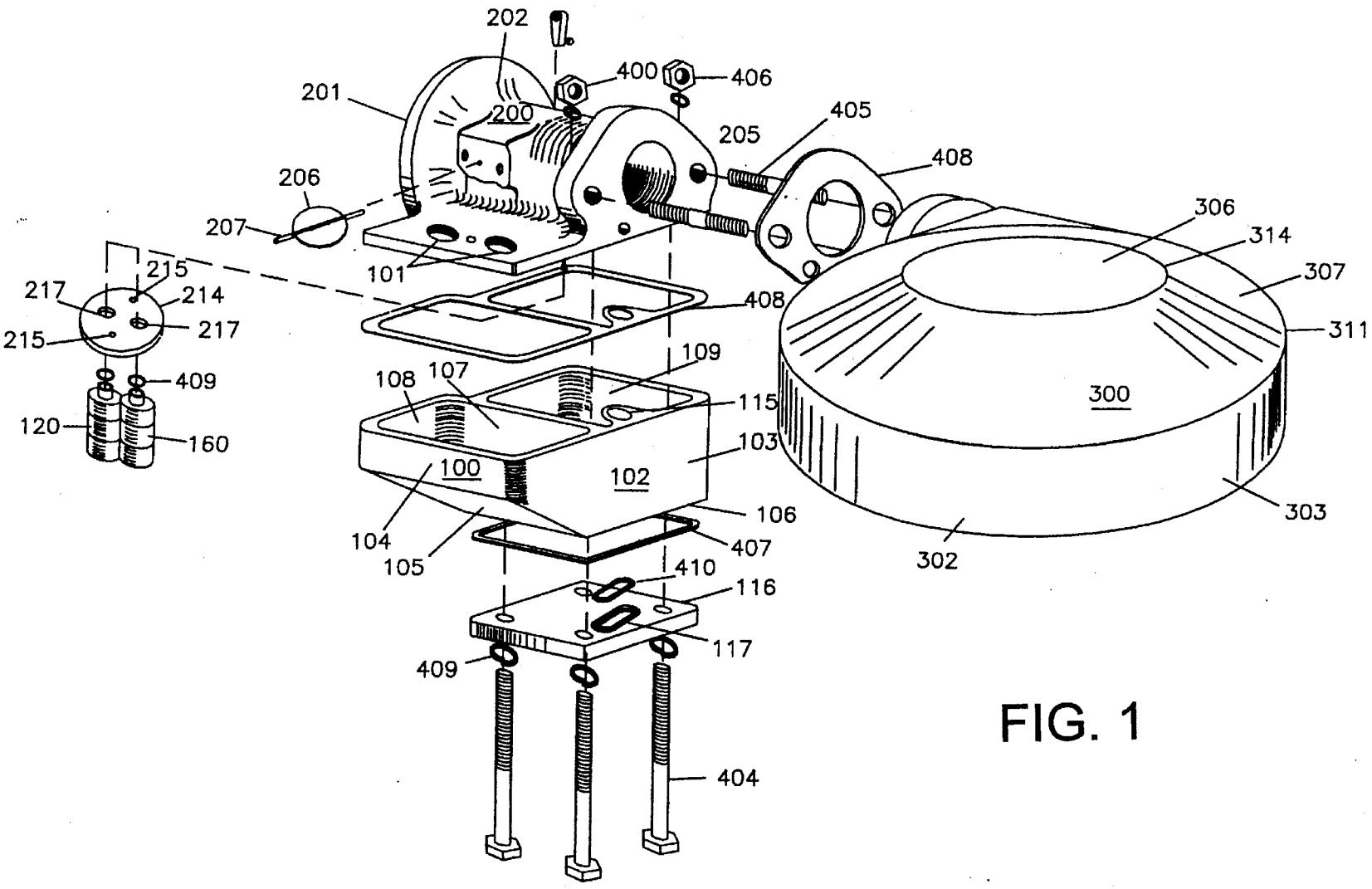
FIG. 1 is an exploded view of the cyclone vortex system.

Turning now to the drawings, FIG. 1 shows the preferred embodiment of the cyclone vortex system.

As shown in FIG. 1, the cyclone vortex system has three main sections: a fuel vaporizing section 100, a main air section 200, and a fuel scrubbing-mixing section 300. The fuel vaporizing section is shown in more detail in FIGS. 2–8. The main air section is shown in more detail in FIGS. 9–13. The cyclone fuel scrubbing-mixing section is shown in more detail in FIGS. 14–15.

Figure 5:
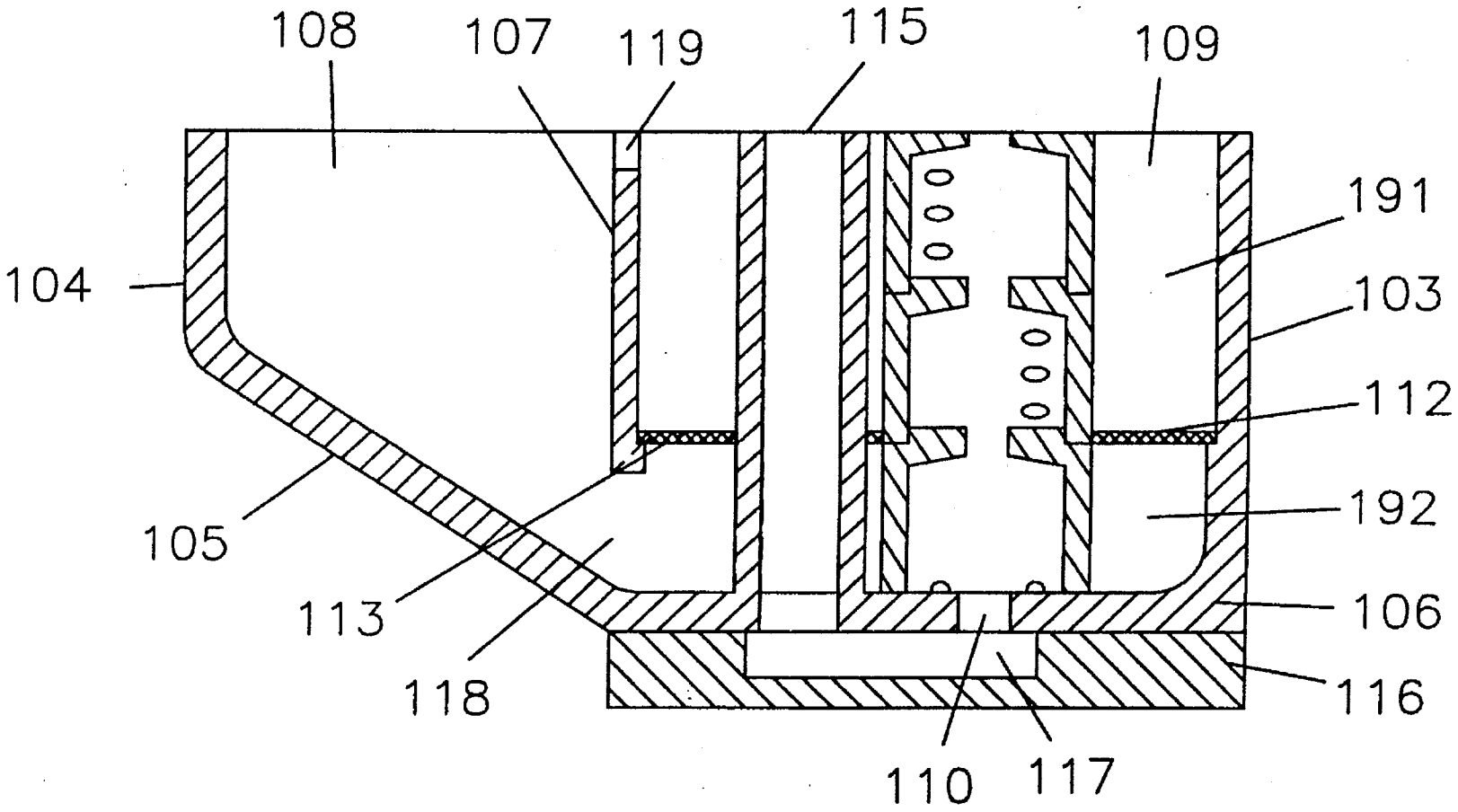
FIG. 5 ms cross-section of the hollow-body portion along line 5—5 of FIG. 2.

The fuel vaporizing section is illustrated as comprising a lower hollow body portion, generally designated 102 (FIG. 1). The body portion is formed by three vertical side walls 103, a fourth shorter vertical side wall 104, a sloping wall 105, and a bottom wall 106. Disposed within the hollow body portion 102 is an intermediate wall 107 dividing the hollow body portion into two chambers. A fuel chamber 108 is formed on one side of the intermediate wall 107 and an air chamber 109 is formed on the other side of the intermediate wall 107. The bottom of the intermediate wall 107 has a lower opening 118 (FIG. 3) and an upper opening 119 therein where the top of the intermediate wall 107 is cutaway to form the opening 119 (FIG. 5).

A pair of vortex stacks 120 and 160 are situated within the air chamber 109 on the floor of the bottom wall 106. The vortex stack 120 (FIG. 4) is referred to as a fresh fuel vortex stack and the vortex stack 160 is referred to as a recycle fuel vortex stack. The recycle vortex stack 160 (FIG. 17) is positioned over the opening 110 (FIG.2) in the bottom wall 106 (FIG. 4).

Figure 7:
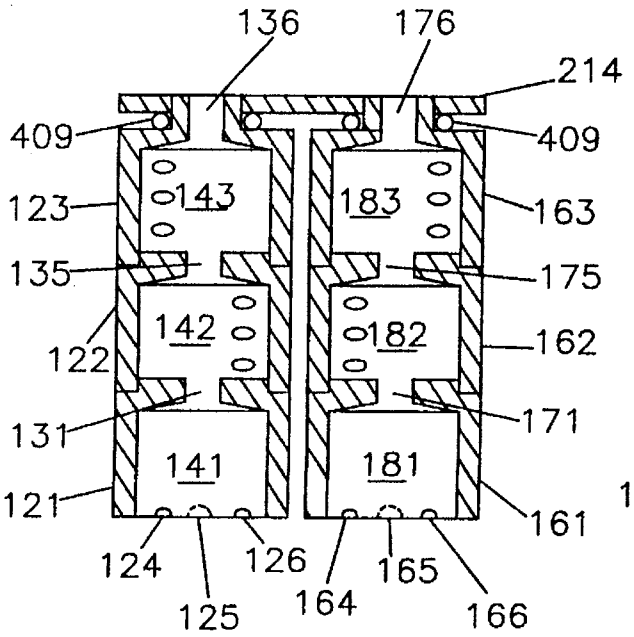
FIG. 7 is a cross-sectional view of the multiple vortex configuration of the cyclone vortex system.
Figure 6:
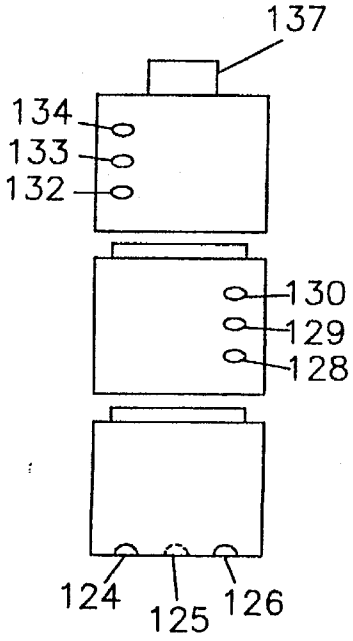
FIG. 6 is an exploded view of the multiple vortex configuration of the cyclone vortex system.

Each vortex stack comprises three hollow-cylindrical tiered vortex units identified as a base vortex unit 121 and 161 (FIG. 8), an intermediate accelerator vortex unit 122 and 162, and a top accelerator vortex unit 123 and 163. The rim or edge 127 and 167 of each base vortex unit 121 and 161 has a plurality of apertures or slots 124, 125 and 126 and 164, 165 and 166 and constricted bores 131 and 171 (FIG. 7). Each intermediate accelerator vortex unit 122 and 162 has a plurality of apertures 128, 129 and 130 and 168, 169 and 170. Also, each intermediate accelerator vortex unit 122 and 162 has a constricted bore 135 and 175 (FIG. 7). Each top accelerator vortex unit 123 and 163 (FIG. 8) has a plurality of apertures 132–134 and 172–174. Also, each top accelerator vortex unit 123 and 163 (FIG. 8) has a constricted bore 136 and 176 (FIG. 7). Each vortex unit 121–123 (FIG. 8) and 161–163 includes a vortex chamber (FIG. 7) 141, 142, 143, 181, 182 and 183. The apertures or slots 124, 125 and 126 for the base vortex unit 121 (FIG. 8) are spaced symmetrically in the rim 127 around the axis thereof. The apertures or slots 164, 165 and 166 for the base vortex unit 161 are spaced symmetrically in the rim 167 around the axis thereof. The respective apertures (FIG. 8) 128–130 and 132–134 for the intermediate accelerator vortex unit 122 and the top accelerator vortex unit 123 are spaced symmetrically along the longitudinal axis of the respective vortex units 122 and 123. The respective apertures 168–170 and 172–174 for the intermediate accelerator vortex unit 162 and the top accelerator vortex unit 163 are spaced symmetrically along the longitudinal axis of the respective vortex units 162 and 163.

An air restrictor plate 112 is (FIG. 5) positioned within the air chamber 109 separating the air chamber into an upper chamber 191 and a lower chamber 192. The air restrictor plate 112 includes a pair of openings (not shown) for accepting the vortex stacks 120 and 160 (FIG. 4). Each air restrictor plate opening is approximately the same size and shape as the horizontal cross-section of a vortex stack. A small ledge 113, is provided on the surfaces of the vertical walls 103 (FIG. 3) and the intermediate wall 107 defining the air chamber 109 (FIG. 5) for positioning the air restrictor plate 112 within the air chamber 109. The ledge 113 is located such that the air restrictor plate 112 is positioned above the floor of the bottom wall 106 but below each of the lowest apertures (FIG. 8) 128 and 168 of the intermediate accelerator vortex units 122 and 162.

Figure 2:
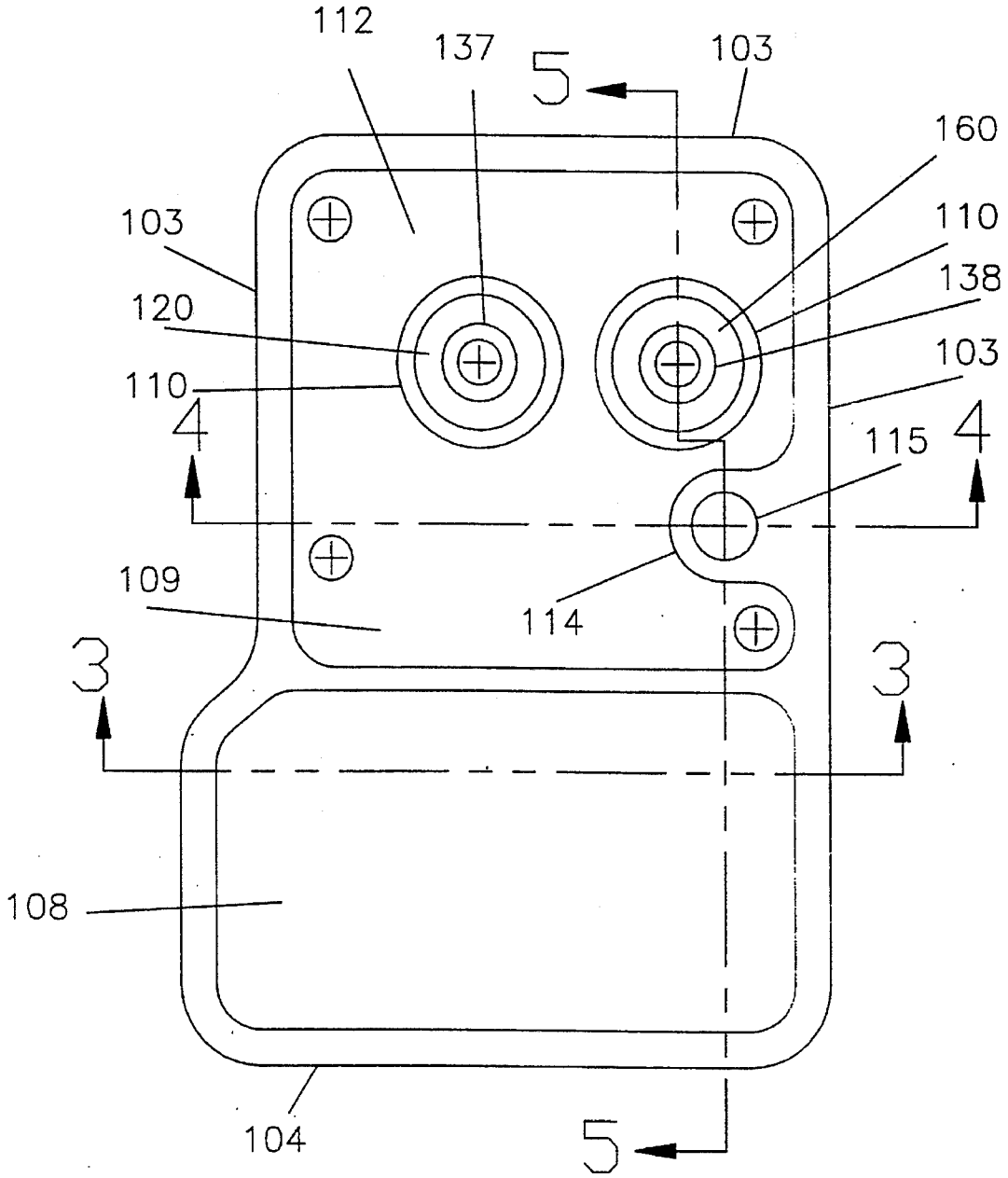
FIG. 2 is a top view of the hollow-body portion of the fuel vaporizing section of the cyclone vortex system.
Figure 3:
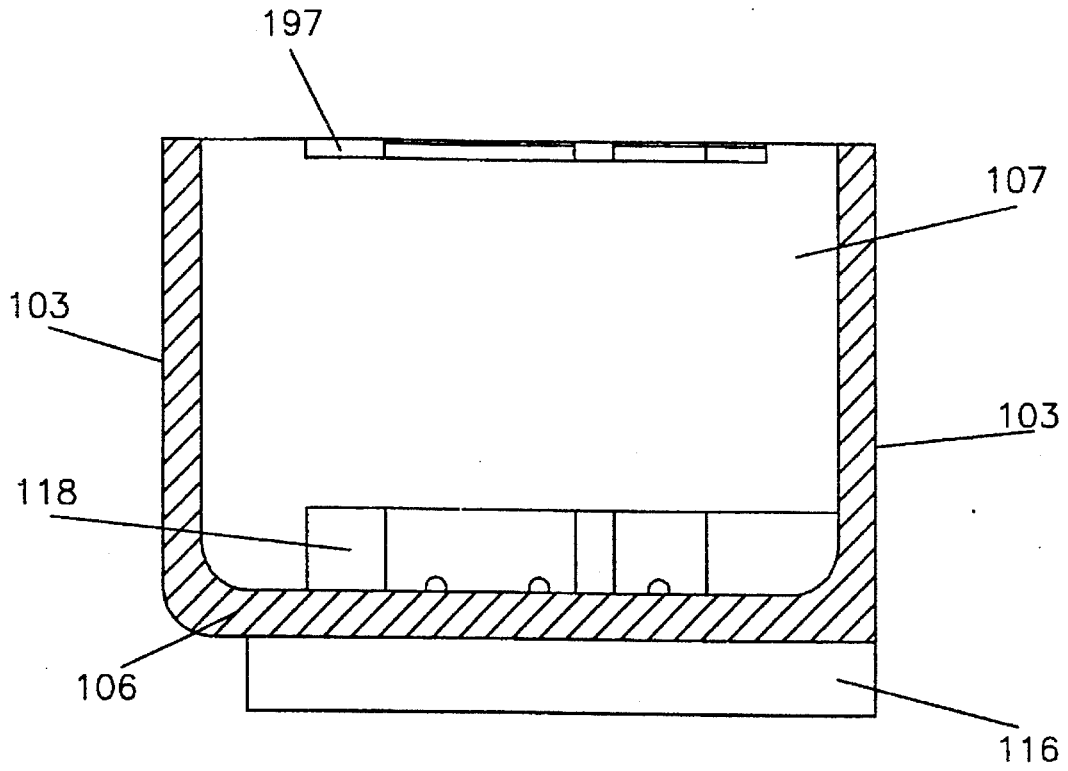
FIG. 3 is a cross-section of the hollow-body portion along line 3—3 of FIG. 2.
Figure 4:
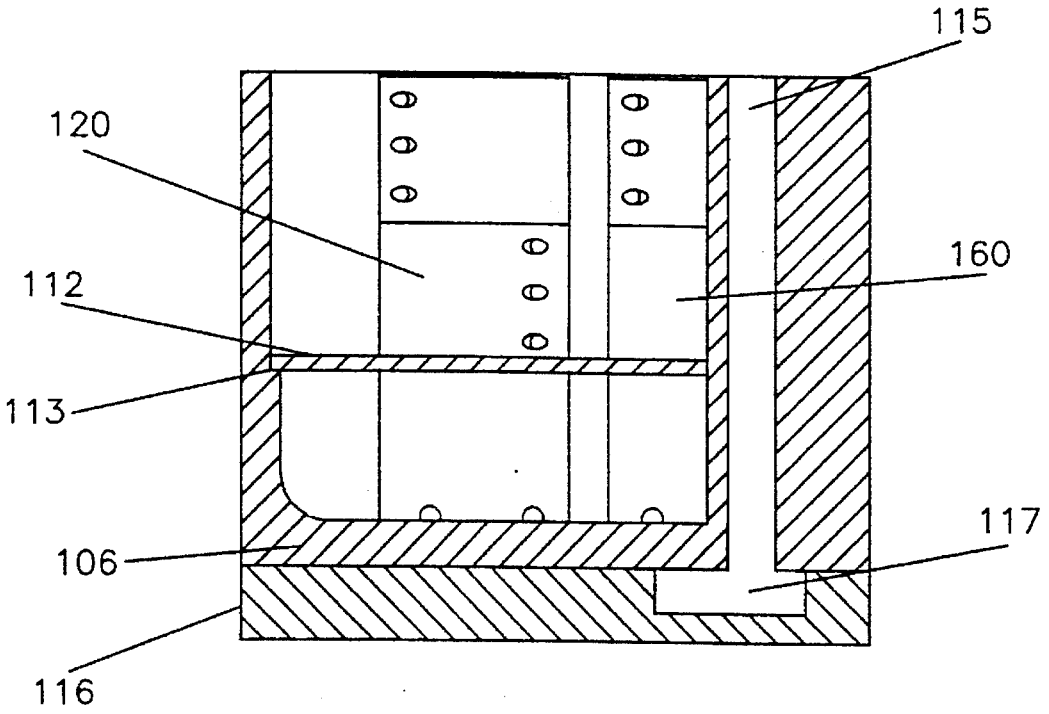
FIG. 4 is a cross-section of the hollow-body portion along line 4—4 of FIG. 3.

As best illustrated in FIGS. 2, 4 and 5, one of the vertical walls 103 has a section 114 protruding into the fuel chamber 109 that includes a conduit 115. As explained hereinafter, the conduit 115 forms part of a channel for returning unvaporized fuel to the recycle vortex stack.

A plate 116 (FIG. 4) having a trough 117 therein is located below the lower surface of the bottom wall 106. The trough 117 communicates with the bottom of FIG. 5, the bore conduit 115 and opening 110.

Next, the main air section 200, as illustrated in FIGS. 1,

6–13 is described. The main air section 200 (FIG. 9) comprises a main air housing or venturi housing 202 having an enlarged interior air intake opening 203 forming a main air input 201 (FIG. 10), a throat 204, a venturi chamber 218 and an enlarged discharge opening 205.

A conventional butterfly throttle plate 206 is mounted within the hollow interior of the throat portion 204 of the housing just inside the venturi air intake opening 203. The throttle plate 206 is conventionally and non-rotatably secured to a rotatable central shaft 207, which is disposed in a horizontal attitude transverse to the direction of air flow through the interior of the housing. Rotation of the shaft 207 will adjust the inclination angle of the throttle plate within the interior of the housing, thereby changing the volume of air/fuel mixture admitted into the engine.

Figure 9:
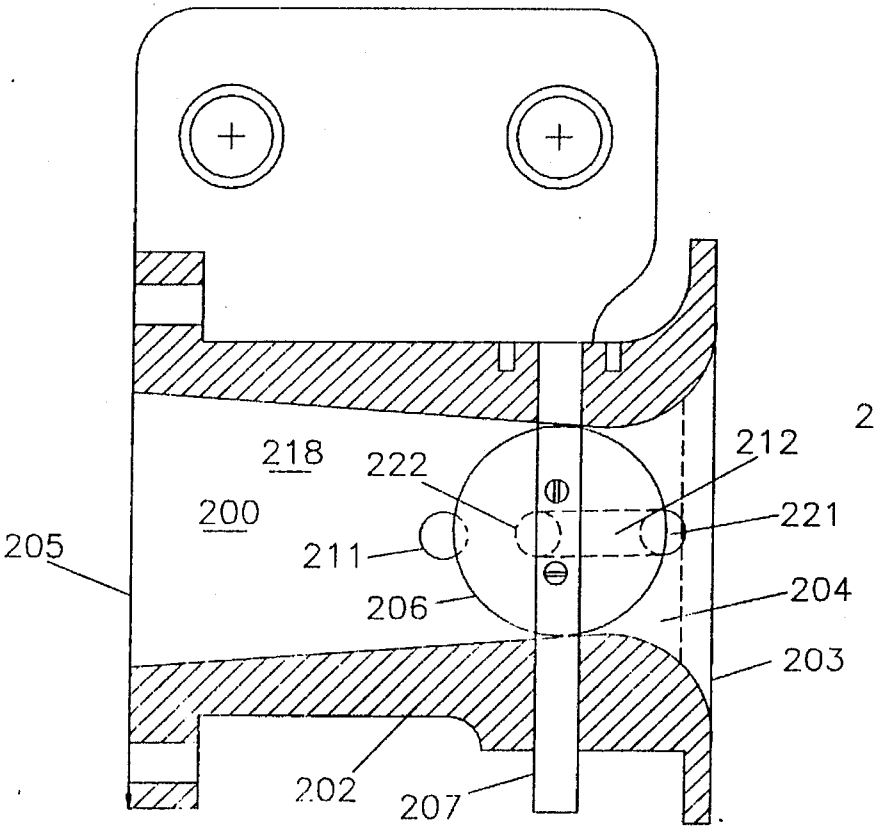
FIG. 9 is a horizontal cross-section of venturi body of the cyclone vortex system along line 9—9 of FIG. 12.

Disposed within the bottom wall 208 (FIG. 10) of the venturi housing is a circular recess 209 and a longitudinal hollowed out portion 210 within the circular recess 209. Also, the bottom wall 208 has a through hole 211 in communication with the enlarged interior intake opening 218 (FIG. 9).

Also, disposed within the bottom wall 208 (FIG. 9) of the venturi housing, adjacent to the enlarged interior intake opening 203, is a hollow interior channel 212 forming an air passageway between an inlet 221 in the interior of the venturi housing 202 and an outlet 222 in the outside of the bottom wall 208 (FIG. 10) in communication with the air chamber 108 (FIG. 5) as will be described hereinafter.

Further, the bottom wall 208 (FIG. 11) has another hollow interior channel 213 that forms a passageway between an inlet 223 in the discharge opening end 205 of the venturi housing 202 and an outlet 224 in the outside of the bottom wall 208.

Figure 8:
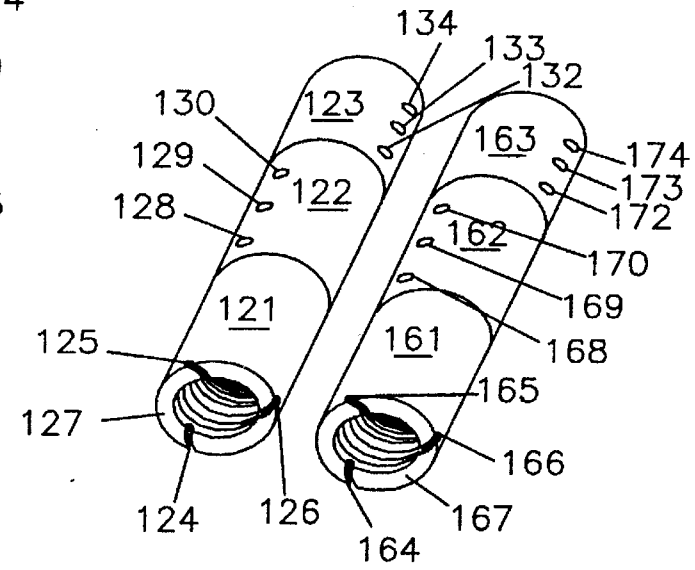
FIG. 8 is a perspective view of the multiple vortex configuration of the cyclone vortex system.
Figure 10:
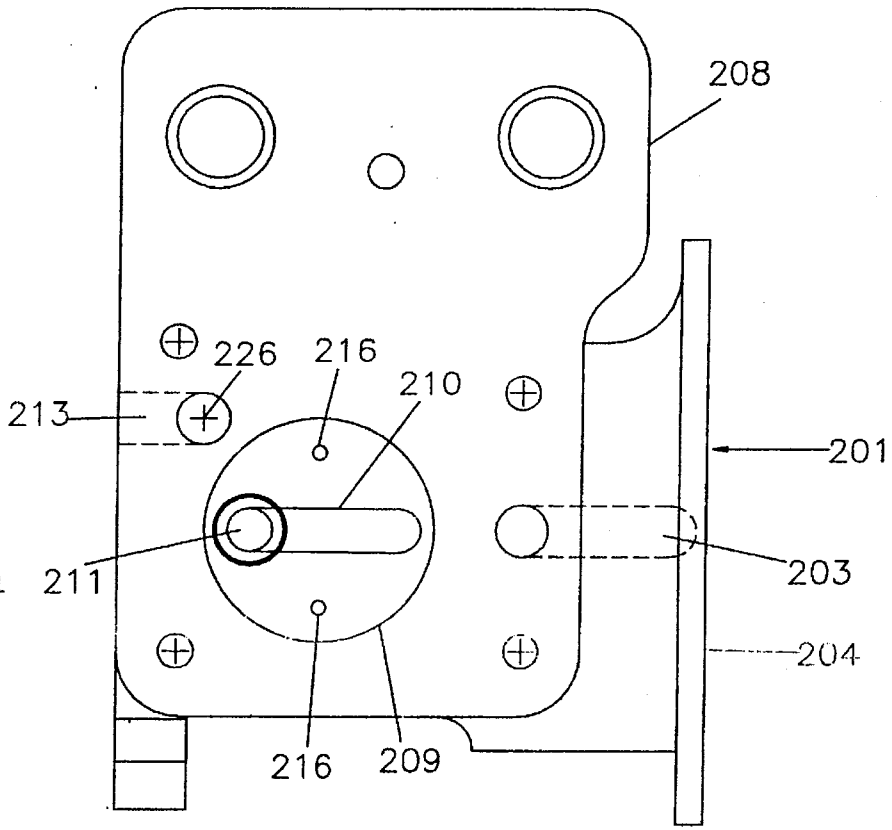

A plate 214 is positioned within the recess 209 (FIG. 10). The plate is approximately the same size and shape as the horizontal cross-section of the recess 209. The plate 214 (FIG. 1) has a pair of through holes 215 that mate with a pair of threaded holes 216 (FIG. 10) in the recess 209. The plate 214 is attached to the venturi housing 202 (FIG. 9) within the recess 209 (FIG. 10) by conventional fastening means by means of the through holes 215 (FIG. 1) and the threaded holes 216 (FIG. 10). Also, the plate 214 (FIG. 1) has a pair of larger holes 217 having approximately the same size and shape as the respective necked-down portions 137 (FIG. 6) of the top accelerator vortex units 123 and 163 (FIG. 8). The plate 214 (FIG. 11) forms the bottom of a vortex chamber 225 in the bottom wall 208 of the venturi housing 202.

Figure 14:
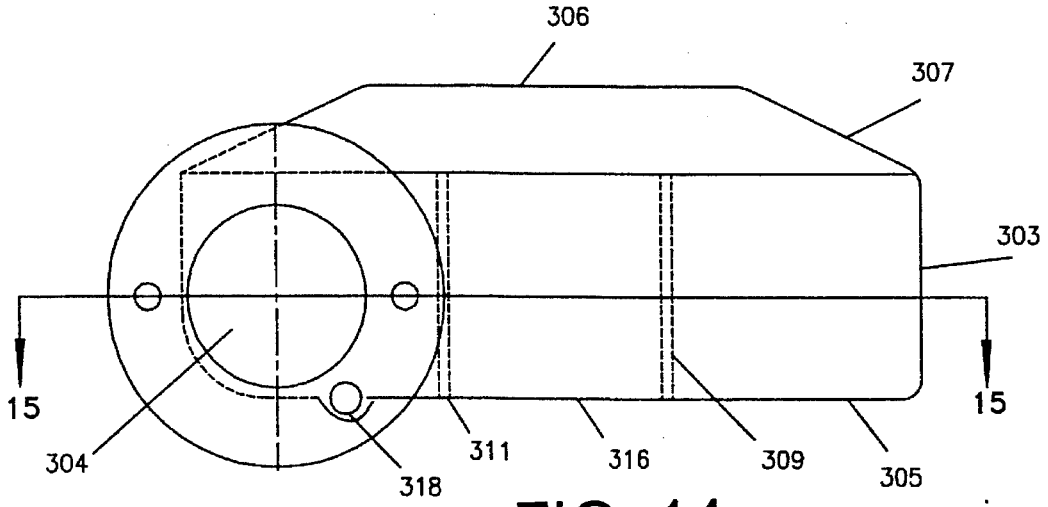
FIG. 14 is an end view of the fuel-air input end of the cyclone of the cyclone vortex system.
Figure 15:
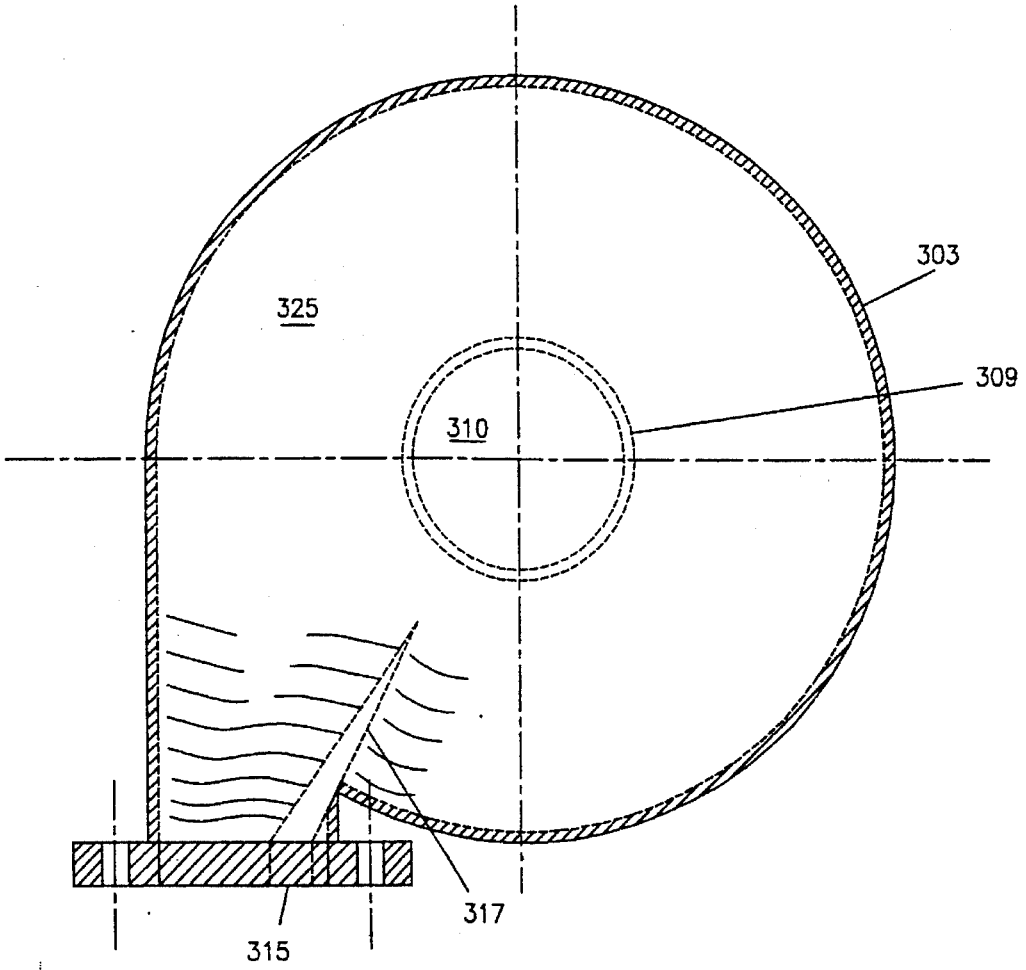
FIG. 15 is a horizontal cross-section of the cyclone of the cyclone vortex system along line 15—15 of FIG. 14.

Next, the fuel scrubbing-mixing section, illustrated in FIGS. 1, 14 and 15, is described. The fuel scrubbing-and mixing section 300 (FIG. 1) includes a centrifuge or main cyclone housing 302 that is a generally cylindrical configuration comprising, an annular vertically directed wall 303 (FIG. 14) interrupted by a main intake opening 304 and a return opening 318. The wall 303 is integral with a bottom wall 305.

The housing 302 also comprises a horizontal top plate 306 and that has a sloping portion 307, which sloping portion is integrally united along its peripheral edge with the top edge of the annular wall 303, thereby closing in air tight relation the entire top of the housing to form a centrifuge or centrifugal-mixing scrubber chamber, or cyclone chamber 325 (FIG. 15).

A central barrel 309 (FIG. 14) having a circular hollow interior (FIG. 15) 310 is disposed within the housing 303 (FIG. 1). The lower portion of the central barrel 309 (FIG. 17) is integrally united along its peripheral edge 311 (FIG. 14) with the bottom wall 305 forming the gas-phase output opening 316 in the bottom wall. The upper end of the central barrel 309 is spaced a predetermined distance below the top plate 306 to accommodate the flow of the vaporized gas-phase fuel-air mixture over the edge of 309 and through the hollow interior 310 (FIG. 15).

Disposed along the bottom of the bottom wall 305 (FIG. 14) is channel 317 (FIG. 15) in communication with the return opening 315 in the annular wall 303.

In assembling the cyclone vortex system, the venturi housing 202 (FIG. 1), including the plate 214 is fitted or slipped over the vortex stacks 120 and 160 with the necked-down portions 137 (FIG. 6) of the top accelerator vortex units 123 and 163 (FIG. 8) sliding through the larger holes 217 (FIG. 1) in the plate 214 and is positioned over the hollow body 102.

The bottom plate 116 is positioned below the bottom wall 106 of the hollow body 102 with the trough 117 aligned with the bottom of the conduit 115 and the opening 110 (FIG. 5).

The bottom plate 116 is provided with bolts 404 and gaskets 407 and 408 for securing and sealing the venturi housing 202 and the bottom plate 116 to the hollow body 102. In addition, fastening means 405 and 406 and a gasket 408 are provided for attaching the centrifuge 302 to the venturi housing 202. Also, O-rings 409 are provided that fit around the necked-down portions of the top accelerator units 123 and 163 (FIG. 8). Further, another sealing ring 410 (FIG. 1) is provided to fit in the trough 117 for sealing the bottom plate and the bottom wall 106.

Figure 16:
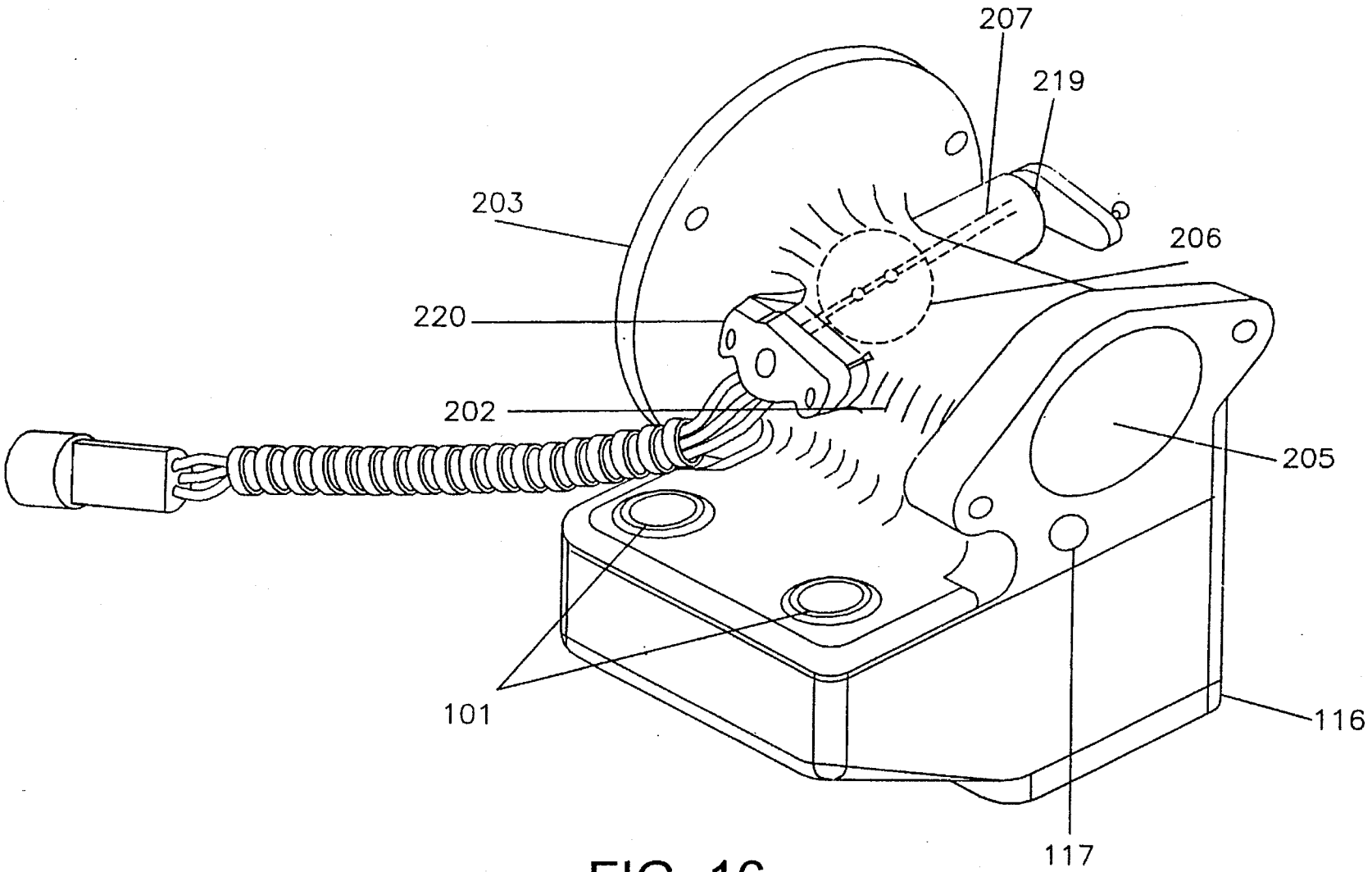
FIG. 16 is a perspective view of the cyclone vortex system showing the relationship between the inputs for the fuel injectors, the throttle position sensor and the throttle ball crank.

As shown in FIG. 16, the venturi housing 202 is provided with a throttle ball crank assembly 219 and a throttle position sensor assembly 220. The openings 101 are for positioning fuel injectors (EFI) therein for metering fuel to the fuel chamber 108 of the hollow body 102 (FIG. 1).

Operation

The operation of the cyclone vortex system follows. Liquid and/or aerosol fuel is electronically controlled and metered through the inputs 101 (FIG. 16) into chamber 108 (FIG. 2) in response to the throttle position sensor 220 (FIG. 16). The throttle sensor is coupled to the central shaft 207 of the throttle plate 206. The throttle plate is controlled by a conventional accelerator pedal (not shown). Hence, the amount of fuel metered through the fuel input 101 is proportional to the position of the throttle plate 206. The liquid aerosol fuel flows into the system as a result of engine vacuum and is drawn through the opening 118 (FIG. 3) in the intermediate wall 107 and into the base vortex apertures or slots of either one of the vortex stacks 120 or 160 (FIG. 4).

Figure 17:
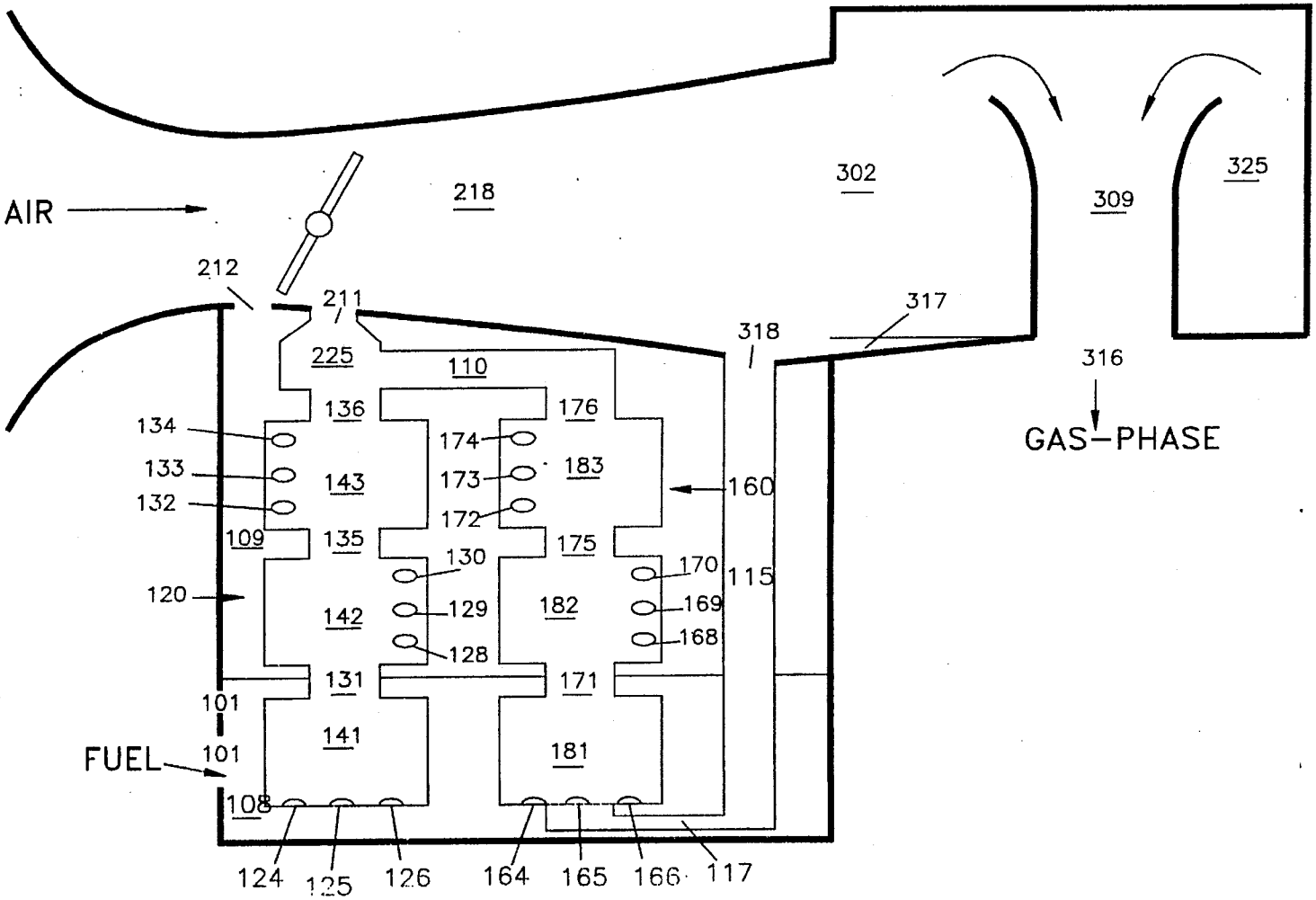
FIG. 17 is a schematic illustration of the cyclone vortex process.

When the engine operates, a partial vacuum in produced in the engines intake manifold. Air enters the venturi's enlarged intake opening 203 (FIG. 9). The throat 204 of the venturi housing 208 (FIG. 11) causes the velocity of the air rushing through the bore of the venturi housing 202 to accelerate and lower its pressure. The lower pressure air at opening 211 (FIG. 9) draws the fuel-air mixture through the vortex stacks 120 and 160 (FIG. 1). The fuel, which enters the base vortex unit 121 or 161 through the apertures 124–126 in the rim 127 and 164-166 in the rim of 167 (FIG. 7) of the base vortex, is a mixture of liquid, aerosol and vapor provided by, for example, fuel injectors as metered fuel via the fuel chamber 108 (FIG. 1) and the opening 118 (FIG. 3) in the intermediate wall 107. The air is provided to the vortex via the channel 212, the air chamber 109, the cutaway openings 118 and 119 through the intermediate wall 107, the fuel chamber 108, and into the chamber 109. The fuel air mixture enters the apertures or slots 124–126, 164–166 (FIG. 17), rotates within the chambers 141 and 181 of the base vortices, exits the base vortices through the constricted bores 131 and 171 between the base vortices and the intermediate accelerator vortices 122 and 162, rotates within the chambers 142 and 182 of the intermediate vortices., exits the intermediate vortices through the constricted bores 135 and 175 between the intermediate vortices and the top accelerator vortices 143 and 183, rotates within the chambers 143 and 183 (FIG. 11) of the top vortices, exits through the constricted bores 136 and 176 (FIG. 17) and enters vortex chamber 225 to combine fluid flows from vortex stacks 120 and 160 and passes then through the hole 211 (FIG. 11) in the bottom wall 208 of the venturi housing 202 into venturi chamber 218. Any of the fuel (recycle plus fresh fuel) entering the chamber 181 of the base vortex unit 161 (FIG. 8) through the opening 110 (FIG. 11) and the apertures 164–166 (FIG. 17) as a combination liquid and fuel aerosol is all converted into an aerosol. The lighter components of the fuel vaporize readily. While passing through the chambers 142, 143, 182 and 183 of the intermediate accelerator chambers the fuel-air mixture is acted upon by air flowing through the apertures 128–130 and 168–170 into the intermediate accelerator chamber and the apertures 132–134 and 172–174 in the top acceleration chambers, the apertures being arranged tangentially to the main vortical flow path to accelerate the spinning motion of the fluid column. This vorticular or spinning flow greatly increases the mean free flow path which the fuel-air mixture must travel and thereby allows for more complete vaporization of the fuel by prolonging the contact and turbulence between the fuel and the air. The fuel-air fluid stream progresses through the venturi chamber 218 (FIG. 17) and into the large chamber of the fuel scrubbing cyclone section 300 (FIG. 1) through opening 302 where the fuel-air flow is acted upon by centrifugal force in the centrifuge chamber 325 (FIG. 17). There, any remaining aerosols recondense as liquid and are collected in the channel 317 (FIG. 15) and returned through the recycle channel comprising, the return opening 315, the hollow internal channel 213 (FIG. 11), the conduit 115, the trough 117 and the opening 110 to the recycle vortex stack 160 (FIG. 17). The recycle fuel vortex stack 160 functions exactly the same as the fresh fuel stack 120 except that the recycle liquid is returned by gravity-vacuum into the base vortex 161 of the recycle vortex stack 160 and is mixed with the diluent fresh fuel aerosol and air. The recycle liquid and the fresh fuel-air mixture enter through apertures or slots 164–166 into the base vortex chamber 181 of the recycle vortex stack 160 where the two entities are combined within one fluid vorticular flow. The recycle fuel enters the base vortex unit 161 (FIG. 8) through the opening 110 (FIG. 11) in the bottom wall 106 (FIG. 5). The fresh fuel-air mixture enters the same base vortex 161 (FIG. 8) through the apertures 164–166 in the rim 167 of the base vortex unit 161. The two accelerator vortex units 162 and 163 operate in a manner similar to the other accelerator stacks 122 and 123. The recycle fuel, fresh fuel and air mixture pass into the venturi chamber 218 (FIG. 11) through the hollowed out portion 210 and the vortex chamber 225 through hole 211 in the bottom wall of the venturi housing 208. Both the recycle vortex stack and the fresh fuel vortex stack operate to vaporize all the liquid and/or aerosol received into a gas-phase.

Next, the detailed operation of the cyclone vortex system will be described with reference to FIG. 17, which is a schematic depiction of the system. Like numerals are used in FIG. 17 to designate the portions of the schematic representing like parts shown in the other figures.

Both of the vortex stacks 120 and 160 (FIG. 17) are physically identical and operate in the same manner except for the fuel mixture passing-there-through, as previously explained. Fresh fuel aerosol-liquid provided by, for example, electronically controlled fuel injectors (not depicted) is fed into the fuel chamber 108 through the fuel inputs 101. Air is provided by the hollow internal channel 212. The fresh fuel-air mixture is drawn through the vortex stacks as a result of engine vacuum (negative pressure) in the venturi chamber 218 at the through hole 211. Fresh fuel and air are drawn through the base apertures 124–126 and 164–166. A vortical fluid-air column is established in each of the base chambers 141 and 181. The angularity of the apertures 124–126 and 164–166 causes air fuel aerosol-fluid to spin or rotate within the chambers 141 and 181. The rotational movement of the fuel aerosol within the vortex chamber 141 and 181 creates a centrifugal or outward force on the fuel aerosol droplets within the fluid column. The fluid mixture column accelerates as the pressure differential changes between the input and output of the constricted bores 131 and 171. The vortical column of fuel aerosol is further accelerated upon passing through the constricted bores 131 and 171 into chambers 142 and 182 by air inflows from accelerator vortex apertures. The accelerator vortex apertures are axially tangential to the now established coherent fluid-air column. Vacuum driven air flowing into the accelerator chambers 142, 143, 182 and 183 by way of the apertures 128–130, 132–134, 168–170 and 172–174 enter the fuel-rich-air-fluid column and enhance the vortex turbulence-envelope while increasing the rotational and columnar velocity.

The fluid column is thus acted upon by high velocity vortical air inflow into the vortex envelopes from the apertures 128–130 and 168–170. As the column moves from chambers 142 and 182 and subsequently, into the chambers 143 and 183, further vortical air inflows from apertures 132–134 and 172–174 act on the vortex envelopes.

Shear forces are developed within each vortex envelope in chambers 142, 143, 182 and 183 at the vortical turbulence interface and at the bores 131, 135, 171 and 175. The rotational vortical speed is accelerated by the vacuum induced inflow into each turbulence envelope by the vectored air inflow from apertures 128–130, 132–134, 168–170 and 172–174. Since all aerosol particles in the vortical column are acted upon by the centrifugal force as a function of their mass, the heavier fuel aerosol particles will be diminished in size as they are sheared at the vortical turbulence interface or will pass through the turbulence envelope to impinge on the vortex chamber inner surfaces (walls). Fuel ligaments will form and either develop plume segment droplets or progress as a liquid film by gravity to the bores 131, 135, 171 and 175 where the fluid column will reacquire the liquid for further processing within each envelope at the turbulence interface. Within the vortically spinning aerosol containing column, the largest or most dense particles are moved to the column surface first and acted upon by the shear forces in the chambers 142, 143, 182 and 183 until the remaining "heavy ends" of the hydrocarbon molecule particles are carried by velocity flow into the centrifuge chamber 325 where a most significant pressure-velocity reduction occurs, allowing the "heavy fraction" aerosols to recondense as liquid and be conveyed through the recycle channels and conduit into the recycle vortex stack 160 (FIG. 17).

As the fluid column enters each sequential constriction, velocity increases and upon exit into the next chamber there is a pressure drop and velocity change in the surface of the columnar flow as the larger cavity is entered. After each pressure drop occurs, vortical inflows occur and the rotational columnar speed again increases. Aerosol loading within the fluid column will attempt to stabilize at any increased velocity, which brings the more massive of the remaining aerosol particles to the column surface turbulence-zone envelope. Thus, it can be assumed that within the cyclone vortex system, the vortically-vectored air-fluid rotation turbulates-shears the liquid first to aerosol, then to a gaseous fluid and finally to the near sonic velocity gas-phase-fluid state as the fluid column enters the venturi at 211.

As used herein, the term "heavy fraction" used to describe the recycle fluid, includes not only the high molecular weight long-chain aliphatic hydrocarbons, but also the aromatic compounds of benzene, xylene, toluene etc. and their derivatives, which have not been vaporized into the gas-phase during the first transit through the vortex stacks as fresh fuels. It should be apparent from the discussion that the "heavy ends" from the liquid-fuel aerosol may recycle many times until they are vaporized and become a gas phase fuel.

The recycle vortex stack 160 functions exactly the same as the fresh fuel stack 120 except that recycle liquid is returned by gravity and vacuum through designated channels or passageways into the center of the recycle stack base vortex 160 as fresh metered fuel enters apertures 164, 165 and 166 to establish the spinning columnar and vortical fluid flow and shear interactions, previously described, in the base chamber 181 and successive vortex chambers 182 and 183. Both vortex stacks are configured and events sequenced to convert all of the liquid or aerosol received into the gas-phase state.

All of the gas-phase fluid containing any unprocessed fuel aerosol from stacks 120 and 160 enters the vortex chamber 225 (FIG 17) where fluid flows intermingle before entering venturi chamber 218. The venturi chamber 218 functions to both increase—maintain the vacuum on the vortex stacks, start the final mixing of the fuel-rich vortex product as it enters the homogenizing centrifuge aerosol scrubbing chamber 305, and progresses thence, into the engine manifold (not shown) after passing through the central barrel 309.

By way of example, the following details of construction are provided in order to better define the structure, operation and application of the cyclone vortex system.

A key feature of the cyclone vortex system is the low pressure, reduced velocity vortex chamber 225 (FIG. 11), which is approximately five times the cross-sectional area of all the vortex apertures in the two vortex stacks 120 and 160. At this point the fresh fuel and recycle fuel flows are first combined. The main intake opening 304 of the centrifuge 302 is 163 times the total cross-sectional area of all the apertures in the vortex stacks 120 and 160.

In the preferred embodiment, the acceleration vortex chamber apertures 128–130, 132–134, 168–170 and 172–174 are positioned tangentially into the vortex inside periphery at a 90° axial angle to provide maximum vorticular effect and columnar rotation. Also, the centrifuge housing 302 is slanted so that gravity can assist the recycle fuel to flow into the channel 317, the recycle channels 115, 117 and 318 and thence into the base of recycle vortex 160. The bottom wall 325 and trough 317 is shaped to effectively collect the recycle fluid.

The distance between the top of the centrifuge 306 and the top of the barrel 309 is 0.900 inches, but may be different for each engine size category.

In the application of the preferred embodiment, engine operational speeds are determined by the total vortex flow capacity and must be predetermined for each general engine size application. The idle speed adjustment screw on the throttle plate bell crank means of past practice is conventionally applied.

Based on the mathematical calculations of engine cylinder(s) swept volume, revolutions per minute, and the total cross-section area of apertures 124–126, 128–130, 132–134, 164–166, 168–170 and 172–174 of the vortex stacks 120 and 160, the velocities of some of the air-fluid flows entering the column and exiting the vortex chamber into the venturi through the through hole 211 is at "near sonic velocity" for a 5.7 liter engine at 1,000 R.P.M. For many "well tuned" engines, this is approximately "idle" speed.

As is common practice with all automobile gasoline engine applications, an inlet air pre-heater, temperature sensor and control means may be used to maintain constant inlet air temperature for either the venturi and/or the vortex configuration. Fuel may be supplied by means of an original equipment high pressure fuel pump and fuel injectors managed by a conventional programmable electronic control module (ECU).

Testing has indicated that the present invention is far superior to the device disclosed in the two prior U.S. Pat. Nos. (4,515,734 and 4,568,500).

The original unleaded gasoline, the recycle liquid coming from the centrifuge chamber and the fuel stock entering the cyclone venturi system were analyzed by infra-red spectroscopy to detect possible oxygenated species being formed by the cyclone vortex process, and by gas chromatography to characterize the aliphatic and aromatic components of these fractions. The gasoline and recycle liquid were analyzed directly from the liquids while the fuel stock entering the system was captured by bleeding the gaseous material from the intake manifold into a vacuum flask prior to analysis.

The infra-red spectra showed the absence of the most likely oxygenated species, alcohols and aldehydes, since there was no detectable absorption due to —OH alcohol bonds or the carbonyl bond of aldehydes, ketches or acids. Therefore the favorable combustion properties of the fuel processed through the cyclone vortex system were not due to chemical oxidation reactions of the fuel components within the cyclone vortex system.

Figure 18A:
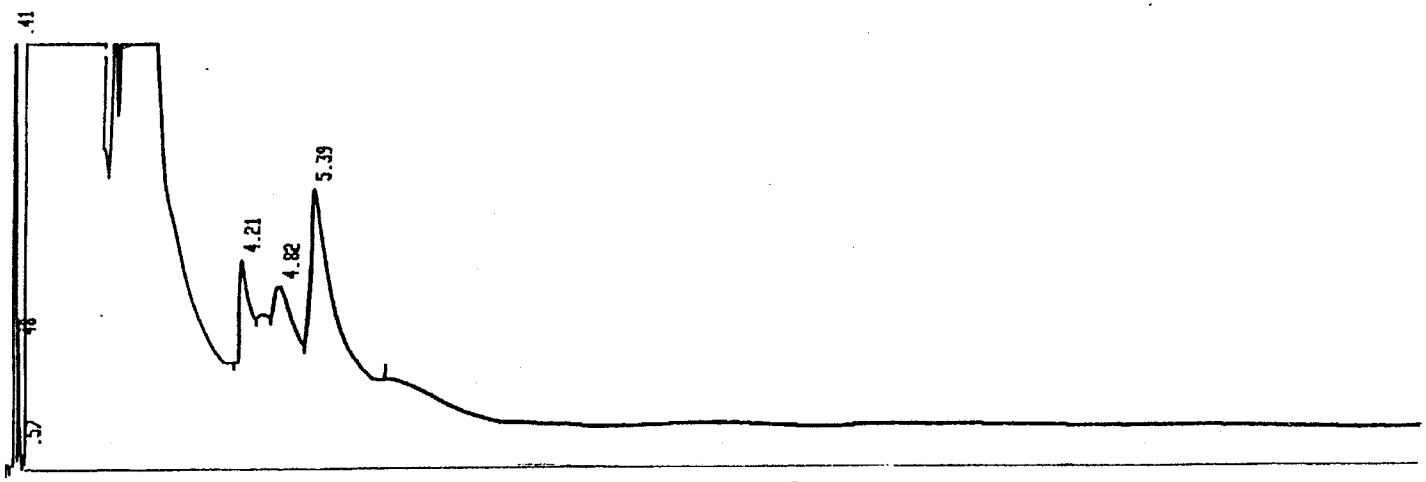
FIG. 18(*a*) is a chart showing the concentration of the molecular components of gasoline.
Figure 18B:
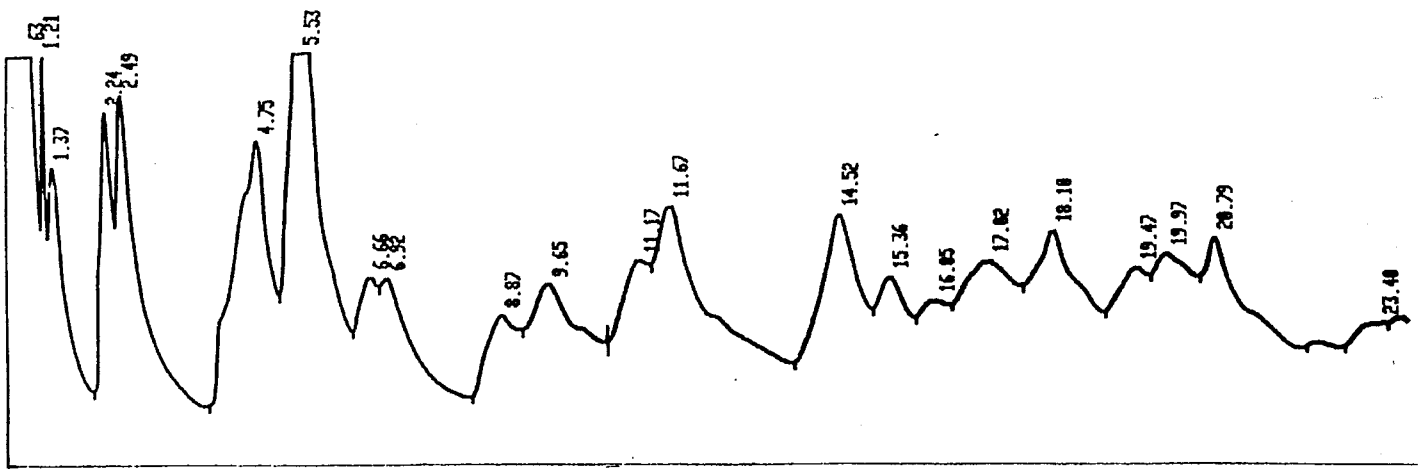

Gas chromatography showed major differences between the original gasoline fraction and the recycle liquid coming from the centrifuge chamber of the cyclone vortex system. The data are shown in FIG. 18(*a*). For this analysis the gasoline and recycle fluid were diluted with pentane to obtain a concentration of the fuel components appropriate for analysis with the gas chromatograph. FIG. 18(*a*) and FIG. 18(*b*) are a composite of two analyses, and the data are included together for ready comparison. The retention times on the abscissa are in minutes, and the ordinate is the absorption of the individual components, which is proportional to concentration. The data were obtained with a Hewlett Packard 5890 Gas Chromatograph apparatus with an automatic sample injector, using a HP-1 (ultra 1) methyl silicone phase capillary column (15 m×0.2. mm). The operating conditions were: 30° C., hold 5 min., increase 5° /min. to 235° C., hold for 1 min. The sample size was 1 μl.

FIG. 18(*a*) is a spectrum obtained by gas chromatography of the gasoline fuel entering the cyclone vortex system. The components coming off with low retention times (up to 2.51 minutes) are the low molecular weight aliphatic hydrocarbons (pentane, hexane, heptane, octane), which are the major components of gasoline fuels.

FIG. 18(*b*) shows similar data for the recycle liquid coming from the cyclone chamber using the same conditions of analysis. The low molecular weight (light) aliphatics are now seen as minor components of the total recycle liquid, while the heavier, less easily vaporized components (aromatics and higher molecular weight hydrocarbons), are concentrated in this fraction and are readily apparent. These heavier components (longer retention times) are also present in the original gasoline fuel, but are not apparent in FIG. 18(*a*) since their concentrations are so low they were not detected at the instrument sensitivity used for these analyses.

Separation of the non-vaporized heavy components shown in FIG. 18(*b*) by means of the cyclone vortex system is a major result of the invention since it prevents their entry into the intake manifold or engine combustion chamber as unvaporized droplets which universally occurs with all current aerosol fuels. Subsequent retreatment of the recycle liquid through the recycle vortex stack (one or more times) leads to the vaporization of these heavy components, allowing them to join the other vaporized components of the fresh fuel and pass into the intake manifold in their readily combustible gas-phase state.

Three Ford original equipment manufacture (OEM) engines have been selected as being typical from many which have been—are operating using the cyclone vortex system in place of a stock carburetor or fuel injection (EFI) system. One of the engines was a four cylinder engine having a displacement of 2300 cubic centimeters. The other two engines were eight cylinder engines, one having a displacement of 351 cubic inches, and the other having a five liter displacement. All engines showed remarkable improvements in fuel mileage with the cyclone vortex system. For example, the four cylinder engine, using the cyclone vortex system, exhibited an improvement of over 40% running at engine speeds of 40 and 50 miles per hour. Likewise, the eight cylinder engine operating at 40 miles per hour had an improvement of over 40% and at 50 miles per hour, had an improvement of over 29%. The five liter engine showed a 17% improvement operating at 65+miles per hour.

In addition, an analysis of the emissions exiting the five liter engine showed that without the cyclone vortex system, the level of carbon monoxide was 0.61% with 136 parts per million of hydrocarbons. With the cyclone vortex system and with all emission control equipment removed, the level of carbon monoxide was 0.02% with only 3 parts per million of hydrocarbons.

Other Embodiments

Variations of the embodiment described above for use in preparing fuel for internal combustion engines are possible.

At the outset, it is pointed out that the cyclone vortex system has wide and important applications since it provides the unique vorticular treatment of fluids. The cyclone vortex system is applicable for homogeneously modifying and controlling the state and composition of hydrocarbon fuels as well as other industrial-process-controlled fluids.

Hence, the vortex configuration can be varied as to number of vortex units as well as the number, shape, sequence and location of apertures in each acceleration vortex unit to optimize the columnar rotational speed and mean free air flow path to optimize turbulence, to control the fuel processing rate, and the output quality of the gas-phase mixture.

For example, with gaseous fuels (propane, LNG, CNG, etc.) the primary function of the vortex stack and the centrifuge is to homogenize the air-fuel fluid to molecularly stoichiometric proportions, which would possibly require a different processing stack sequence than an oxygenated gasoline-alcohol blended fuel.

For micro sized engines, the entire air flow can be routed through a multiple venturi-vortex configuration, which utilizes conventional "diaphragm" fuel flow management techniques as a cyclone vortex system fuel feed.

In addition, the number, dimensions, and configurations of apertures or slots in the rim of each base vortex unit can be varied to optimize fuel input and vorticular speed. For example, the annular slots (or flow capacity thereof) in each base vortex unit could be configured to be continuously variable and responsive to the throttle position and, changes in the fuel processing requirements, all of which can affect cyclone scrubber capacity requirements and "recyle" fuel flow rate.

In another variation, the vortex units from both stacks can be configured into one stack to allow variations in fuel input and to maximize processing efficiency for both fresh and recycle fluid. In this variation, both the recycled liquid and the fresh fuel would be fed directly to the base vortex input of the single stack and the interior shape of the base vortex smoothly tapered from the rim to a constricting bore 171. Enhancement of ligamented film flows on the interior walls of the accelerator vortex chambers may also be accomplished with catalytic coatings or specific roughness variations. It is also possible that the constricted bores, such as 131, 135, 171, 175 etc. can be treated by micro-machining techniques to enhance or optimize plume droplet formations and re-entry into the vortical fluid column.

Moreover, the vortex configuration can be matched to the engine size depending on whether the engine, for example, is a small engine, a single or multiple cylinder engine, a four cycle engine, or a two cycle engine with lubricating oil injection into the fuel-air fluid stream between the cyclone vortex system and the crankcase or manifold entry port.

The vortex stack(s) could be placed in varying positions, i.e., horizontal, vertical, etc., to conform with space constraints and physical-environmental conditions and to optimize fuel-fluid flows rates. This configuration is extremely important when designing fuel systems for use with very simple engines and poor quality fuels.

Further, the preferred embodiment may be modified to provide thermally processed air directly to the vortex stacks to optimize the vaporization rate of specific fuels and/or for cold weather/environment-equipment operation. For example: providing air at 260° F. to the vortex stacks may enhance the fuel processing rate with minimized recycle flows, while a lower temperature could overload the recycle system. It is always desirable to hold venturi air temperatures to the 78°–80° F. range for optimal vaporization efficiency.

In yet further variation, the input for the fresh fuel could be a direct passageway to the base vortex unit with passages to balance the recycle flow and fresh fuel liquid flows to one or multiple stacks. In this variation, the restriction plate could be eliminated.

Figure 11:
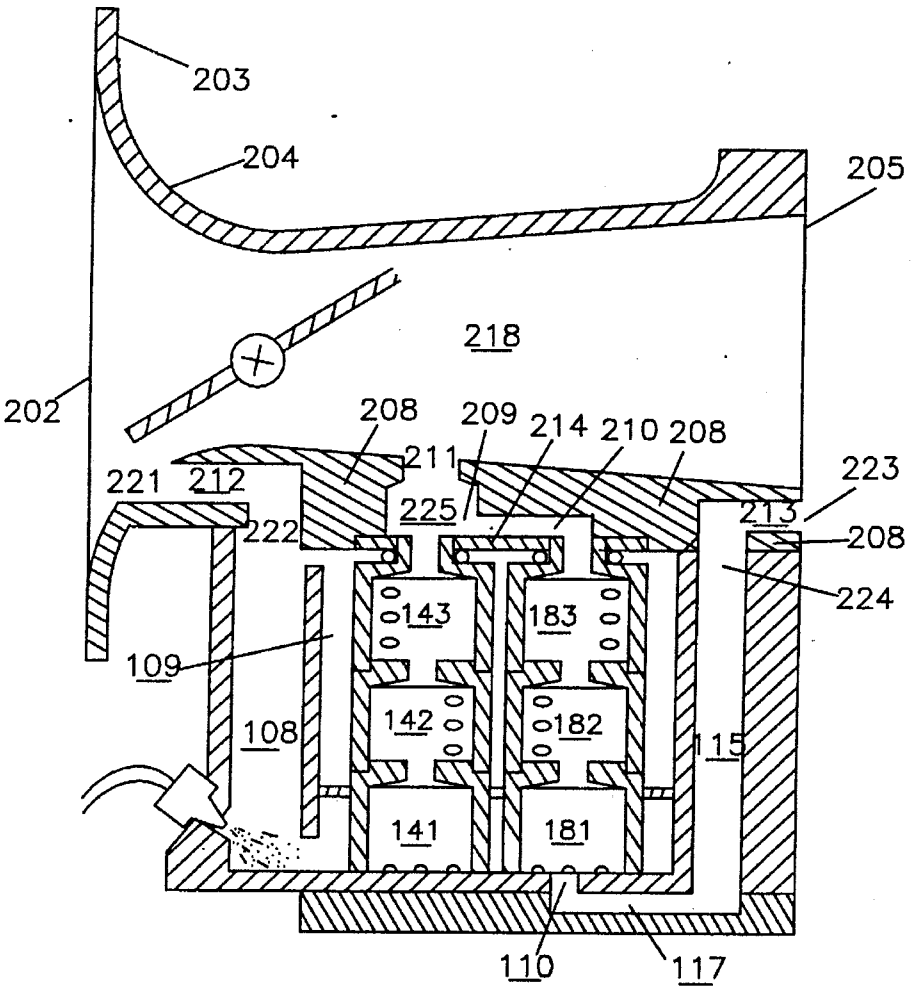
FIG. 11 is a vertical cross-section of the venturi body and fuel vaporizing section of the cyclone vortex system, showing the atmospheric inlet air channel, the vortex connecting channel and the fuel recycle return channels along line 10—10 (and 10*a*—10*a*) of FIG. 12.
Figure 13:
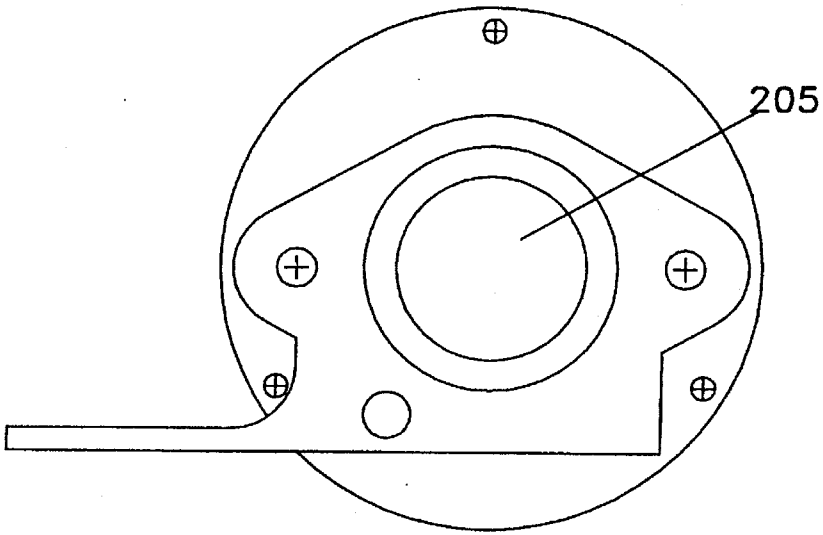
FIG. 13 is an end view of the fuel-air output end of the venturi body of the cyclone vortex system.
Figure 12:
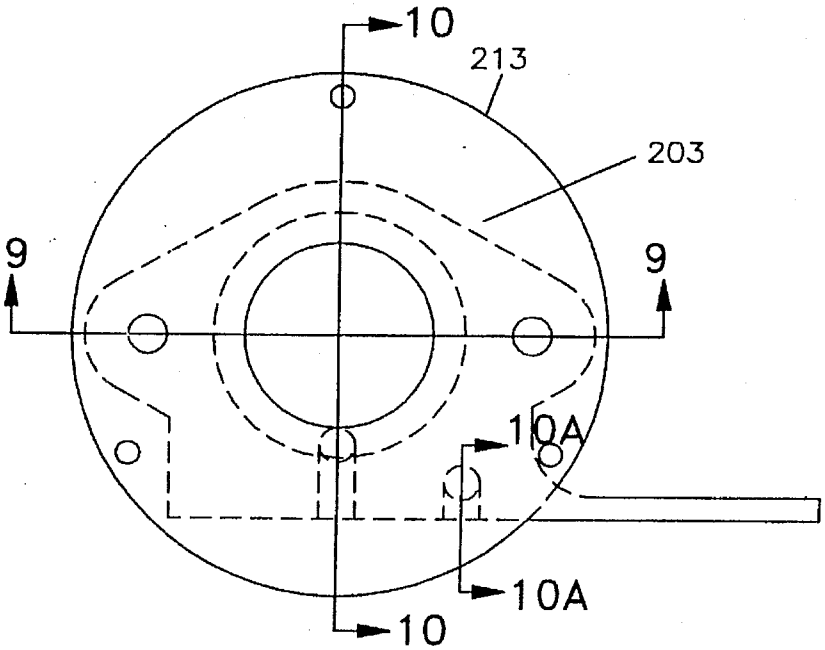
FIG. 12 is an end view of the air input end of the venturi body of the cyclone vortex system.

In addition, the fuel inputs for the fuel injection could be located on different parts of the hollow body portion 102 as depicted in FIGS. 11 and 17, and the number of fuel injectors varied according to the capacity of each (lbs. per hour) and the engine(s) (system) fuel requirement.

Further, fuel for the cyclone vortex system can be supplied through use of conventional float bowl(s), carburetion jets, metering rods, accelerator pumps, etc.

The present invention has been disclosed as being useful primarily for processing fuel such as gasoline into a gas-phase mixture for use in internal combustion engines. However, the cyclone vortex system of the present invention is not limited to preparing such a fuel. Rather, the cyclone vortex system can be used to process-vaporize any appropriate type of fluid. In this context "process" may mean to vaporize to gas-phase only the lighter portions of the fluid to enhance the blending of fluids which would otherwise be difficult or impossible such as hydrocarbon, water and/or various chemical or gaseous fluid flows with differing physical characteristics, i.e., surface tension.

"Process" may also mean to vaporize only the more volatile portion of a fluid and/or combine a gaseous-vapor with an aerosol to enhance chemical mixing or combustion of external combustion boiler fuels etc.

The cyclone vortex system can be utilized to vaporize fluids such as:

1. lighter fuel oils to which residue or surface film controlling fuel additives can then be injected or added;
2. a specific fuel "fraction" or "CUT" from petroleum refinery production for specific internal combustion engine, boiler, or burner applications;
3. viscous vapor concentration, such as propane, liquified natural gas, compressed (cryogenic) natural gas, into a homogenous-non-detonating gas phase;
4. multiple mixed gasses and/or combinations of gasses and liquids for industrial process control or prime mover fuel;
5. oxygenated fuel (alcohol) and/or gasoline-alcohol blends thereof;
6. water as a combustion enhancer for combustion temperature control;
7. water-emulsified fuels for either internal or external combustion devices where residue control is necessary;
8. liquids and/or gaseous materials for enhancing feedstock properties and liquid processing speed in molecular separation sequence and/or gaseous membrane separation technology; and
9. hydrocarbon fuels, and/or combinations thereof for many turbine fuel applications such as jet aircraft with either negative or positive air pressure operating systems;

In processing a particular fluid, the number of vortex stacks, the number of vortex units, and the number of apertures in each vortex unit is determined by the magnitude of the demand for cyclone vortex system processed fluid. Sufficient vortex capacity must exist to convert the fluid-aerosol into the gas-phase without overloading the recycle vortex system. Also, there must be a sufficient number of vortex elements to process the quality and quantity of fuel being presented to the system at the fluid-source input. In fact, for stationary power plants or operations where space and cold weather start-up and shut down are not major concerns, and where the quality of the fluid entering the cyclone vortex system need only be consistent with the primary vortex function, the centrifuge and the recycle feature could be eliminated, allowing for a higher capacity fluid preparation flow through only a primary vortex path. Moreover, the venturi housing could be eliminated when throttling is unnecessary. In addition, the output from the vortex configuration could be fed directly to the centrifuge when processing slurries and unstable material.

The cyclone vortex system can also be used with positive air pressure for mobile or stationary fuel usage applications such as for external combustion gun burners for boilers, heating applications, and other chemical applications. Positive pressure from gaseous fuels will serve the same purpose as an air vortex system driver to enhance vaporization of boiler fuels. The cyclone vortex system can also be used as a toxic-waste oil combustion unit for the ecological clean up of PCBs or other liquid toxic materials and for blending mixtures of water hydrocarbon or other industrial materials where heat reduction or chemical blending can be accomplished from the gas phase state.

Advantages of Cyclone Vortex System

The major problems associated with internal combustion engines using a mixture of vaporized hydrocarbons and liquid aerosol droplets are inefficiently performing engines, and air pollution caused by such inefficiently performing engines operating at pollution-generating high temperatures. Fuels prepared by the cyclone vortex system have the advantage of dramatically improving engine performance while decreasing polluting emissions.

The cyclone vortex system allows efficient combustion of all applicable fuels by stoichiometrically pre-conditioning the fuel and air prior to entry into the engine. The fuel is transformed into a stable (chemically fixed), homogenous, stoichiometric, oxygen balanced, gas-phase state. This promotes an improved distribution of the fuel-air mixture to the cylinders, a much improved combustibility of the fuel/air mixture, and results in an efficient use of the inherent chemical energy in the fuel. More of this chemical fuel energy is converted to work than has ever before been possible.

Moreover, the high temperatures required for fuel vaporization within the intake manifold and cylinder combustion chambers of conventional internal combustion engines are not needed for the fuel prepared by the cyclone vortex system. Combustion temperatures remain at levels less than the threshold temperature above which Nitrogen and Oxygen combine during luminous flame combustion to form NOx (at approx. 2800°F.).

Further, the "heavy ends" of the fuel containing wax-gum elements often are the nucleus for the very large aerosol droplets. The cyclone vortex system separates the larger droplets and the recycle feature captures all liquid aerosols and recycles them until the droplets are reduced to a gas-phase air/fuel mixture, which goes into the engine and is oxidized along with the more volatile fractions of the fuel.

As for improving engine performance, the use of cyclone-vortex-system prepared fuel eliminates the typical "flee front" combustion in the engine cylinders. This results in unique improvements in all relevant combustion and emission parameters. There is virtually no "knock" or detonation when operating an engine with fuel processed by the cyclone vortex system with either the compression ratios of around 8 to 9.5:1 found in conventional engines or even with any mechanically attainable higher compression ratios of 20:1 or above. Thus it is possible to operate an engine in its original equipment configuration, or to optimize the BMEP (brake mean effective pressure) by altering the compression ratio, valve timing, and ignition occurrence (timing) to achieve maximum fuel economy and minimum emissions. The stock, the 20:1 plus compression ratio, or supercharged engine configurations will produce operating conditions providing greatly reduced (or eliminated) emissions of carbon, UHC (uncombusted hydrocarbons), CO, aldehydes, and NOx (oxides of nitrogen).

Moreover, the luminous flame front combustion which occurs with current internal combustion engines requires that the spark must start many degrees prior to piston top dead center to allow for "slow" combustion without detonation while still enabling reasonable engine power output. Gasoline that is prepared in the cyclone vortex system has the advantage of combusting without any detonation and with other unique beneficial characteristics such as lower temperature, less NOx, less CO and UHC, where maximum cylinder pressure develops much more rapidly allowing spark-fuel ignition to occur much nearer top dead center (TDC). This focuses more of the available expansion pressure from combustion into usable torque and power.

In addition, luminous flame combustion produces large amounts of radiant and other forms of energy which must then be absorbed by the engine structure and dispersed by the cooling system. A high percentage of fuel energy is lost through radiated energy in the combustion chamber. However, cyclone vortex system prepared fuel oxidizes without many of these losses through non-luminous or "blue flame," or "cold" combustion.

Further, fuels prepared by the cyclone vortex system should have the benefit of extending engine life. The reduction of carbonaceous particulate matter and possibly organic acids resulting from the incomplete or inefficient combustion will provide the advantage of reducing engine wear. Reduced engine wear can therefore be added to improved fuel economy and increased engine efficiency with the attendant pollution reduction as the real advantages of the cyclone vortex system technology.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of the invention.

What is claimed is:

1. A method of preparing a gas-phase fuel-air mixture for an internal combustion engine, comprising the steps:

providing a plurality of fuel-air mixture flow paths;

selectively controlling the flow of fuel and air along said fuel-air mixture flow paths;

vortically spinning said fuel in a portion of each of said fuel-air mixture flow paths for creating vortically spinning columns of fuel and air;

continuously delivering air tangentially into each of said vortically spinning columns of fuel and air;

turbulently and vortically commingling said air delivered into each of said vortically spinning columns of fuel and air for vortically shearing said fuel into a substantially vaporized fuel-air mixture;

vortically homogenizing and mixing said fuel-air mixture and causing unvaporized fuel to impinge upon a separating surface;

returning said liquid to the beginning of one of said fuel vaporizing flow paths for vaporizing said liquid; and exiting the vaporized fuel-air mixture as a gas-phase fuel-air mixture for use in an internal combustion engine, wherein the step of vortically spinning the fuel is carried out in plurality of consecutive portions of each of said fuel vaporizing flow paths for creating a plurality of vortically spinning columns of fuel and air, air is continuously delivered tangentially into each of said vortically spinning columns of fuel and air, and turbulently and vortically commingling said delivered air with each vortically spinning column of fuel and air for vortically shearing said fuel into a substantially vaporized fuel-air mixture.

2. A cyclone vortex system for vaporizing a fluid into a gas-phase fluid, comprising:

a fluid vaporizing cylindrical vortex configuration having at least one vortex unit with a chamber, an input to said chamber and an output from said chamber for allowing a fluid to flow between said input and said output, wherein said input includes a plurality of apertures located in a rim at one end of said vortex configuration and said output is a constricted opening located in another end of said vortex configuration, and wherein said fluid vaporizing cylindrical vortex configuration has another plurality of apertures for inputting air tangentially to the flow of fluid between said input and said output for vaporizing said fluid into a gas-phase fluid-air mixture.

3. The cyclone vortex system for vaporizing a fluid into a gas-phase fluid according to claim 2, further comprising:

an opening in said one end of said vortex configuration;

a centrifuge housing having an intake opening in communication with said output from said vortex unit chamber, a centrifuge chamber for cyclonically separating non-vaporized fluid from vaporized fluid and homogeneously mixing the fuel-air mixture, a central barrel located within said centrifuge chamber having an input for receiving said vaporized fluid and air and an output for exiting said vaporized fluid and air from said centrifuge housing, and a return opening for returning said non-vaporized fluid to said opening in said one end of said vortex configuration for vaporizing said non-vaporized fluid.

4. The cyclone vortex system for vaporizing a fluid into a gas-phase fluid according to claim 2, wherein said fluid vaporizing cylindrical vortex configuration has a tiered plurality of vortex units, each vortex unit having a vortex chamber for vaporizing a fluid, wherein the vortex chamber in each vortex unit is joined by a constricted bore, with the lowermost vortex unit of said tiered plurality of tiered vortex units having said a plurality of apertures located in a rim thereof at an end of said lowermost vortex unit opposite the end with a constricted bore therein, wherein each vortex unit other than said lowermost vortex unit includes said another plurality of apertures, and wherein the uppermost vortex unit of said tiered plurality of vortex units having said output.

5. The cyclone vortex system for vaporizing a fluid into a gas-phase fluid according to claim 4, wherein said tiered plurality of vortex units includes three vortex units.

6. The cyclone vortex system for vaporizing a fluid into a gas-phase fluid according to claim 2, wherein said fluid vaporizing cylindrical vortex configuration has a plurality of tiered plurality of vortex units, each vortex unit having a vortex chamber for vaporizing a fluid, wherein the vortex chamber in each vortex unit is joined by a constricted bore, with the lowermost vortex unit of each of said tiered plurality of tiered vortex units having a said plurality of apertures located in a rim thereof at an end of said lowermost vortex unit opposite the end with a constricted bore therein, wherein each vortex unit other than said lowermost vortex unit includes said another plurality of apertures, wherein the uppermost vortex unit of said tiered plurality of vortex units having said output, and wherein each output of each uppermost vortex unit is joined to provide a common output.

7. The cyclone vortex system for vaporizing a fluid into a gas-phase fluid according to claim 6, wherein each of said tiered plurality of vortex units includes three vortex units.

8. The cyclone vortex system for vaporizing a fluid into a gas-phase fluid according to claim 2, further comprising:

a venturi housing having a chamber with a throat, a main air intake opening, a throttle plate positioned in said throat of said venturi chamber for controlling the quantity of air passing through said venturi chamber, a discharge opening, a through hole located between said main air intake opening and said throttle plate for providing air from said main air intake opening to said fluid vaporizing cylindrical vortex mixing configuration, and at least one passageway located between said throttle plate and said discharge opening for receiving the flow of fluid and air from said fluid vaporizing cylindrical vortex configuration; and wherein said discharge opening is for discharging the flow of fluid and air from said venturi chamber.

9. The cyclone vortex system for vaporizing a fluid into a gas-phase fluid according to claim 8, wherein said fluid vaporizing cylindrical vortex configuration has a plurality of tiered plurality of vortex units, each vortex unit having a vortex chamber for vaporizing a fluid, wherein the vortex chamber in each vortex unit is joined by a constricted bore, with the lowermost vortex unit of each of said tiered plurality of tiered vortex units having said a plurality of apertures located in a rim thereof at an end of said lowermost vortex unit opposite the end with a constricted bore therein, wherein each vortex unit other than said lowermost vortex unit includes said another plurality of apertures, wherein the uppermost vortex unit of said tiered plurality of vortex units having said output, and wherein each output of each uppermost vortex unit is joined to provide a common output.

10. The cyclone vortex system for vaporizing a fluid into a gas-phase fluid according to claim 9, wherein each of said tiered plurality of vortex units includes three vortex units.

11. The cyclone vortex system for vaporizing a fluid into a gas-phase fluid according to claim 8, further comprising:

an opening in said one end of said vortex configuration;

a centrifuge housing having an intake opening in communication with said venturi discharge opening, a centrifuge chamber for cyclonically separating non-vaporized fluid from vaporized fluid and homogeneously mixing the fuel-air mixture, a central barrel located within said centrifuge chamber having an input for receiving said vaporized fluid and air and an output for exiting said vaporized fluid and air from said centrifuge housing, and a return opening for returning said non-vaporized fluid to said opening in said one end of said vortex configuration for vaporizing said non-vaporized fluid.

12. The cyclone vortex system for vaporizing a fluid into a gas-phase fluid according to claim 11, wherein said fluid vaporizing cylindrical vortex configuration has a tiered plurality of vortex units, each vortex unit having a vortex chamber for vaporizing a fluid, wherein the vortex chamber in each vortex unit is joined by a constricted bore, with the lowermost vortex unit of said tiered plurality of tiered vortex units having said a plurality of apertures located in a rim thereof at an end of said lowermost vortex unit opposite the end with a constricted bore therein, wherein each vortex unit other than said lowermost vortex unit includes said another plurality of apertures, and wherein the uppermost vortex unit of said tiered plurality of vortex units having said output.

13. The cyclone vortex system for vaporizing a fluid into a gas-phase fluid according to claim 12, wherein said tiered plurality of vortex units includes three vortex units.

14. The cyclone vortex system for vaporizing a fluid into a gas-phase fluid according to claim 11, wherein said fluid vaporizing cylindrical vortex configuration has a tiered plurality of vortex units, each vortex unit having a vortex chamber for vaporizing a fluid, wherein the vortex chamber in each vortex unit is joined by a constricted bore, with the lowermost vortex unit of said tiered plurality of tiered vortex units having said a plurality of apertures located in a rim thereof at an end, of said lowermost vortex unit opposite the end with a constricted bore therein, wherein each vortex unit other than said lowermost vortex unit includes said another plurality of apertures, and wherein the uppermost vortex unit of said tiered plurality of vortex units having said output, and wherein said opening in said one end of said vortex configuration is located in said end of said lowermost vortex units opposite the end with a constricted bore therein.

15. The cyclone vortex system for vaporizing a fluid into a gas-phase fluid according to claim 14, wherein said tiered plurality of vortex units includes three vortex units.

16. The cyclone vortex system for vaporizing a fluid into a gas-phase fluid according to claim 15, wherein said fluid is fuel, further comprising:

a hollow body portion having an intermediate wall separating said hollow body portion into a fuel chamber with a fuel input for receiving fuel therein and an air chamber for receiving air from said through hole in said venturi housing, said intermediate wall having a pair of openings, one of said intermediate wall openings for allowing air to flow from said air chamber to said fuel chamber and the other of said intermediate wall openings for allowing fuel and air to flow from said fuel chamber to said air chamber; and wherein said fluid vaporizing cylindrical vortex configuration is positioned in said air chamber for receiving said fuel and air.

17. The cyclone vortex system for vaporizing a fuel into a gas-phase according to claim 16, further comprising:

a restrictor plate separating said air chamber into an upper chamber and a lower chamber such that each of the lowermost vortex units are positioned in said lower chamber and the remaining vortex units are positioned in said upper chamber.

18. The cyclone vortex system for vaporizing a fluid into a gas-phase fluid according to claim 11, wherein said fluid vaporizing cylindrical vortex configuration has a plurality of tiered plurality of vortex units, each vortex unit having a vortex chamber for vaporizing a fluid, wherein the vortex chamber in each vortex unit is joined by a constricted bore, with the lowermost vortex unit of each of said tiered plurality of tiered vortex units having said a plurality of apertures located in a rim thereof at an end of said lowermost vortex unit opposite the end with a constricted bore therein, wherein each vortex unit other than said lowermost vortex unit includes said another plurality of apertures, wherein the uppermost vortex unit of said tiered plurality of vortex units having said output, wherein each output of each uppermost vortex unit is joined to provide a common output, and wherein said opening in said one end of said vortex configuration is located in said end of at least one of said lowermost vortex units opposite the end with a constricted bore therein.

19. The cyclone vortex system for vaporizing a fluid into a gas-phase fluid according to claim 18, wherein each of said tiered plurality of vortex units includes three vortex units.

20. The cyclone vortex system for vaporizing a fluid into a gas-phase fluid according to claim 19, wherein said fluid is fuel, further comprising:

a hollow body portion having an intermediate wall separating said hollow body portion into a fuel chamber with a fuel input for receiving fuel therein and an air chamber for receiving air from said through hole in said venturi housing, said intermediate wall having a pair of openings, one of said intermediate wall openings for allowing air to flow from said air chamber to said fuel chamber and the other of said intermediate wall openings for allowing fuel and air to flow from said fuel chamber to said air chamber; and wherein said fluid vaporizing cylindrical vortex configuration is positioned in said air chamber for receiving said fuel and air.

21. The cyclone vortex system for vaporizing a fuel into a gas-phase according to claim 20, further comprising:

a restrictor plate separating said air chamber into an upper chamber and a lower chamber such that each of the lowermost vortex units are positioned in said lower chamber and the remaining vortex units are positioned in said upper chamber.

* * * * *